US005314081A

United States Patent [19]

Carroll

[11] Patent Number: 5,314,081

[45] Date of Patent: May 24, 1994

[54] RISER AND DIVIDER SYSTEM FOR A DISPLAY APPARATUS

[75] Inventor: Francis A. Carroll, Dublin, Ireland

[73] Assignee: Carroll Products and Designs Limited, Dublin, Ireland

[21] Appl. No.: 13,994

[22] Filed: Feb. 5, 1993

Related U.S. Application Data

[63] Continuation of Ser. No. 640,193, Jan. 10, 1991, abandoned.

[30] Foreign Application Priority Data

Jan. 10, 1990 [IE] Ireland ..... 88/90

[51] Int. Cl.[5] ..... A47F 5/00

[52] U.S. Cl. ..... 211/184; 211/11

[58] Field of Search ..... 211/184, 43, 11; 108/60, 61

[56] References Cited

U.S. PATENT DOCUMENTS

| | | | |
|---|---|---|---|
| 2,820,684 | 1/1958 | Zadek et al. | 211/184 X |
| *2,894,303 | 7/1959 | Armstrong et al. | 211/184 X |
| 3,750,894 | 8/1973 | Jensen et al. | 211/184 |
| 4,768,661 | 9/1988 | Pfeifer . | |

FOREIGN PATENT DOCUMENTS

| | | |
|---|---|---|
| 0320858 | 6/1989 | European Pat. Off. . |
| 1554323 | 4/1969 | Fed. Rep. of Germany . |
| 8912517 | 3/1990 | Fed. Rep. of Germany . |
| 355024 | 7/1961 | Switzerland . |
| 490071 | 8/1938 | United Kingdom . |

*Primary Examiner*—Alvin C. Chin-Shue
*Assistant Examiner*—Sarah A. Lechok
*Attorney, Agent, or Firm*—Rothwell, Figg, Ernst & Kurz

[57] ABSTRACT

The riser and divider system of the invention includes risers 1, dividers 2, two divider connectors 3 on each divider 2 and cross divider. Each connector 3 has a hook 5 which grips the riser 1 or other divider 2. A tongue 4 is provided on each divider 2 for the retention of the connector 3. The pinned riser fixing component 21 comprises a plug 22 having a shoulder 23 and pin 24. The shoulder 23 fits in the corresponding shaped cut-out and the pin 24 fits through poles provided in the shelf. The system also includes an end-stop 28 which is fixed to the end of each riser 1. A stabilizer component is optionally provided on a divider 2. Other components are support clips 211 and 231.

The system can be used for the erection of standard riser and divider arrangements, stepped divider arrangements, binning arrangements, hopper arrangements, shelf-arrangements and various other shop display.

13 Claims, 27 Drawing Sheets

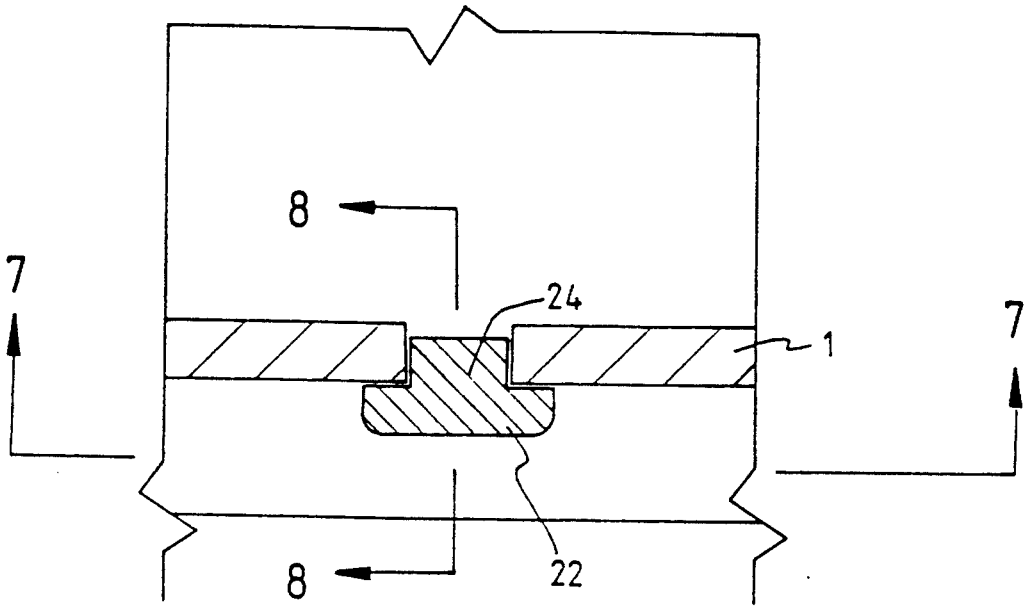
FIG.9
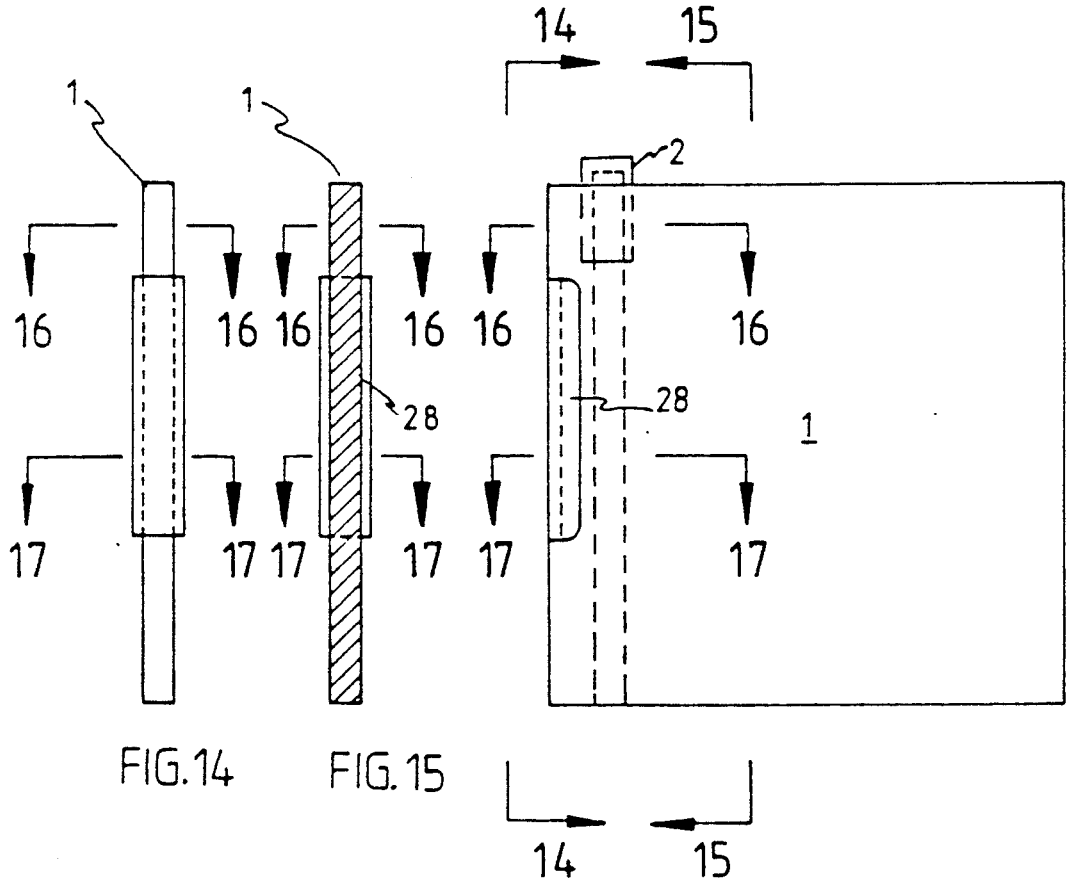
FIG.14 FIG.15
FIG.13

RISER AND DIVIDER SYSTEM FOR A DISPLAY APPARATUS

This is a continuation of application Ser. No. 07/640,193, filed Jan. 10, 1991, now abandoned.

The present invention relates to a binning/dividing system for display shelving apparatus, generally known as risers and dividers and hereinafter referred to as a riser/divider system.

Shopfitting shelving systems fall into two main categories, those utilising 1) timber shelves and 2) metal shelves.

Within each of these categories numerous variations of specification and design details occur particularly with regard to metal shelves. In general, metal shelving accounts for a substantial majority of all shelves used, particularly in high volume businesses like multiple supermarkets, department stores etc.

Traditionally glass and, to a lesser extent, wire have been used throughout the industry for sub-dividing shelves into compartments or bins to facilitate separating/merchandising of a wide variety of products and to prevent slippage of products off horizontal and sloping shelves. Taking a standard shelf riser/divider system as an example, the front and rear elements constitute the risers and the elements bridging the risers are the dividers. The elements which bridge the dividers internally are known as cross-dividers.

Transparent plastics material, generally acrylic and occasionally polycarbonate, have emerged in recent years as a replacement for the traditional materials mainly because of the inherent physical advantages of plastics materials over traditional materials.

However, no satisfactory plastics riser and divider system has emerged which is compatible with all the various types of shopfitting shelving systems in use in the market as a whole. Each metal shelving and timber shelving manufacturer has tended to develop their own system designed to suit their own specific shelving details with no regard for compatibility with other shelving systems. As a result a vast number of incompatible and generally badly designed riser and divider systems are available on the market place causing much confusion to the end users and general dissatisfaction to all concerned.

The object of the invention is to provide a riser and divider system which is compatible with all known metal and timber shelving systems. The system comprises components fabricated from plastics sheet material either in a flat or bent state and components produced by injection moulding.

The former are designed for production on state-of-the art CNC machining equipment capable of matching the precision of the injection moulded components while offering cost effective mass production capacity. Utilising the very latest materials technology the injection moulded components are virtually unbreakable and designed for mass production assembly eliminating traditional loose-separate connector devices and/or solvent glueing techniques.

The present invention provides a riser and divider system for a shelving display apparatus, including at least one riser and at least one divider, each of which comprises a rigid sheet of plastics material, and a connector for disengagably connecting together the riser and divider, the connector comprising securing means for fixing the connector to one of the riser and divider and engaging means for disengagably connecting the connector to the other of the riser and divider.

Advantageously, one of the riser and divider includes an integrally formed receiver element, the securing means of the connector includes a socket fixable to the said receiver element and the disengagable engaging means of the connector includes a clip element.

Advantageously, the receiver element comprises a tongue onto which the socket of the connector is fixable, and the clip element comprises a resilient hook member which is adapted to grip the other of the riser and the divider.

Advantageously, the resilient hook member is spaced from the socket so as to define a gap which in its relaxed state narrows progressively from its closed end to its open end so as to provide a tight grip on the rigid sheet of material located in the gap.

Advantageously, the resilient hook member, when viewed from one side approximates to the shape of the numeral "7", the short arm of the "7" being contiguous with a wall of the socket, with the cross-sectional thickness of the hook member progressively decreasing from the junction of the short arm and long arm of the "7" towards their ends, and with the cross-sectional thickness of the portion of said wall of the socket adjoining the end of the short arm of the "7" being thicker than the portion of said wall of the socket remote from the short arm of the "7", thereby giving the hook member a strong construction and whereby when a force is applied to the hook member, stress is spread along the arms of the "7" and the hook member tends to disengage from the sheet of material rather than break.

Advantageously, the connector is manufactured from a high strength plastics material, such as polycarbonate, which is stronger than the rigid sheet of plastics material.

The connector which preferably is injection moulded in clear polycarbonate material has been reduced dramatically in size from any known existing connector component and is designed to push fit onto the machined divider component making it ideal for fast permanent production assembly without traditional solvent glueing. Existing divider connector systems would be either glued to the divider or provided as separate components rendering them vulnerable to loss in store etc. Visual attractiveness of the reduced size riser/divider connector produced in crystal clear polycarbonate material has advantage over existing systems together with the fact that the polycarbonate is an unbreakable material and will stand up to much more use and abuse than existing materials used e.g. pvc/acrylic/polystyrene etc.

Preferably, the connector is common to all end, mid and cross dividers regardless of shelf type and provides infinite flexibility in positioning of dividers.

Advantageously, the system includes a plug member, a first portion of which is engageable with one of the riser and divider and a second portion of which is provided with a pin or projection engagable with a complementary receiver provided on the display surface.

Preferably, a formation is provided in the relevant riser or divider, the formation being engagable with the first portion of the plug member.

Preferably, the formation is a slot and the first portion of the plug member comprises a shoulder of complementary shape to the slot.

The plug with the pin is designed for fixing risers to metal shelves with perforated, punched or slotted front and back detail. Traditionally this type of shelving required risers to have metal channel with welded pins attached, fixed to the base of the riser by means of drilling and pop riveting. Generally this metal assembly needs to be chromium plated or similar to protect the metal from rusting etc. This assembly is both costly and unsightly and the co-ordination of precision metal fabrication and finishing facilities with acrylic fabrication facilities causes endless problems for manufacturers and end-users alike.

Preferably, the plug is of polycarbonate and is set into the base of the riser component so as to overcome totally the necessity for metal fabrication of any kind other than the provision of steel or similar pins to suit hole diameters or slots in the metal shelves.

The plug with the pin can be applied to timber shelves which traditionally utilise separate metal or plastic post type L-shaped corner, T-shaped and H-shaped fittings set in drilled holes or inserts which in turn carry glass or similar riser/divider components. No production or design changes to shelves are needed to incorporate the new system.

Advantageously, the system further includes an end stop member engagable with an end of the riser or divider, said riser or divider including a formation to accommodate the end stop in a manner which substantially does not add to the overall length of the riser or divider.

Preferably, the end stop is injection moulded polycarbonate and is designed to prevent end dividers sliding off risers at the end of a shelf. In traditional glass shelving this was simply not possible and even in existing acrylic systems blocks of acrylic glued onto the ends of risers tended to be bulky, ugly and extremely inefficient from a manufacturing point of view. The end stop of the invention is designed in the form of a channel made to the thickness of the riser material. The riser is precision routed so that the end stop detail finishes perfectly flush with the end of the riser, thus facilitating end to end continuous butt jointing without gaps where risers run from shelf to shelf in a continuous run. For example, the cost efficiency of production, assembly and fixing by ultrasonic welding is a key factor in the design of this component and also size and choice of material makes it visually unobtrusive.

Advantageously, the system includes a support clip which comprises a riser/divider lower corner receiving element and a mounting portion mountable on or about the display surface.

The invention further provides a stabilising element which comprises a securing means for fixing the element to one of the riser and divider and at least one foot for resting on a display surface and thereby stabilising the riser/divider.

Preferably, the optional stabilising element is injection moulded from clear polycarbonate material and can be fitted to the base of dividers, if required, by means of machining the acrylic divider in exactly the same way as the divider/riser connector component. The addition of this stabilising component helps to maintain the divider in its vertical mode but would only be used in certain circumstances where this factor is critical. The design of this component is such that the stabilizer can be assembled with the same speed and ease as the connector component.

The complete suite of four simple injection moulded components (plus one optional component) provides a universal, compatible and cost effective solution to the riser and divider problem for literally all known shelving systems on the market.

Advantageously, the sheet of material constituting one of the riser and divider includes at least one bend parallel to one of its edges so as to provide at least two flat surfaces at an angular relationship to one another, whereby the riser/divider may be in the form of a bin, bin divider, hopper or other three dimensional shape.

Advantageously, the sheet of material constituting one of the riser and divider is a flat sheet of material, two edges of which are flat and with at least one edge contiguous to said flat edges being of an irregular shape, whereby a plurality of such sheets of material may be used to form stepped, tiered or other multi-level displays.

The invention will now be described more particularly with reference to the accompanying drawings, which show, by way of example only, the display apparatus according to the invention in a number of embodiments or arrangements.

In the drawings:

FIG. 9 is a sectional elevation along the line 9—9 of FIGS. 7 and 8;

FIG. 13 is a front view of the riser showing the end stop component inserted in the notch provided in the riser;

FIG. 14 is a side view along the line 14—14;

FIG. 15 is a sectional elevation along the line 15—15;

Figure 18A:
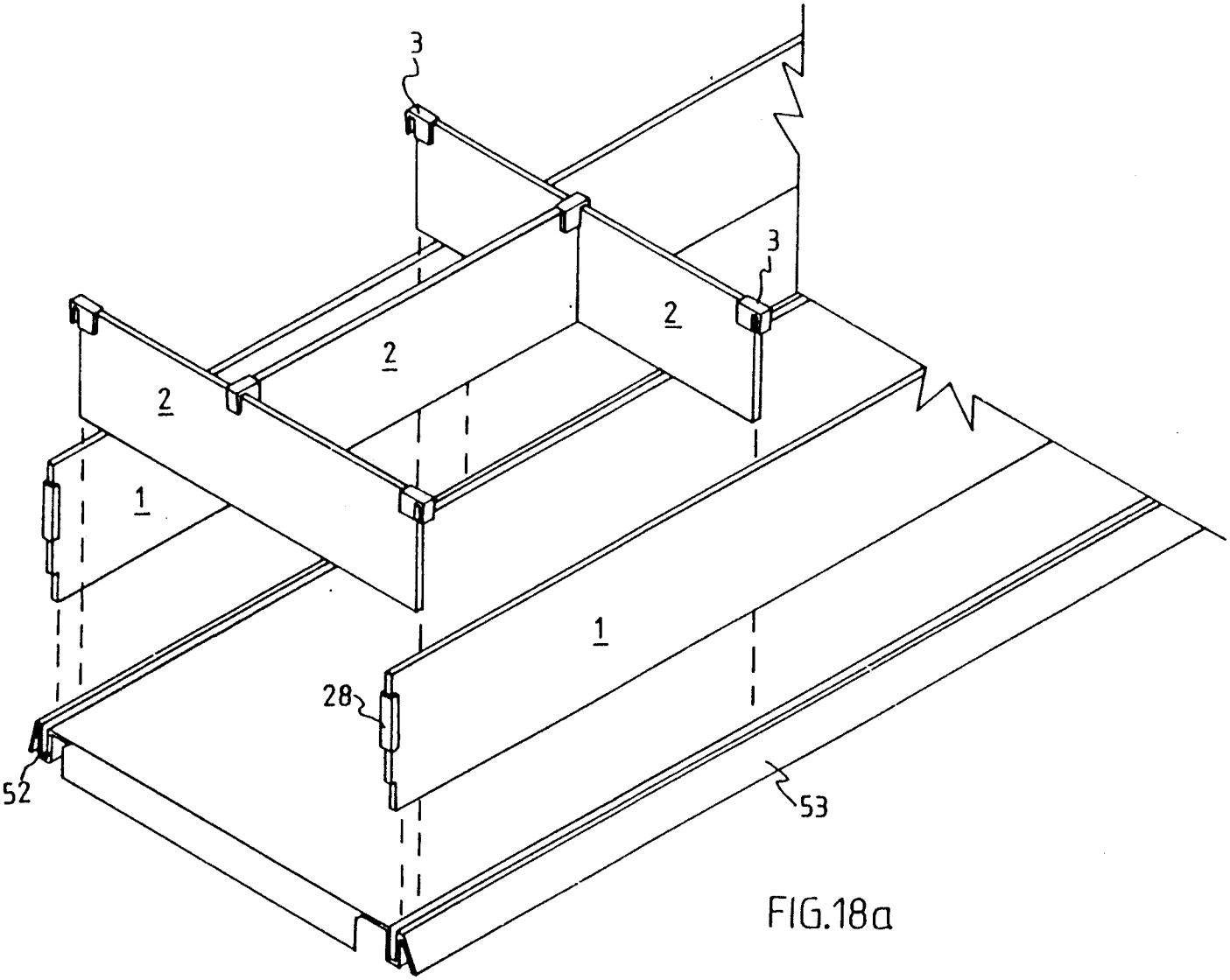
Figure 18B:
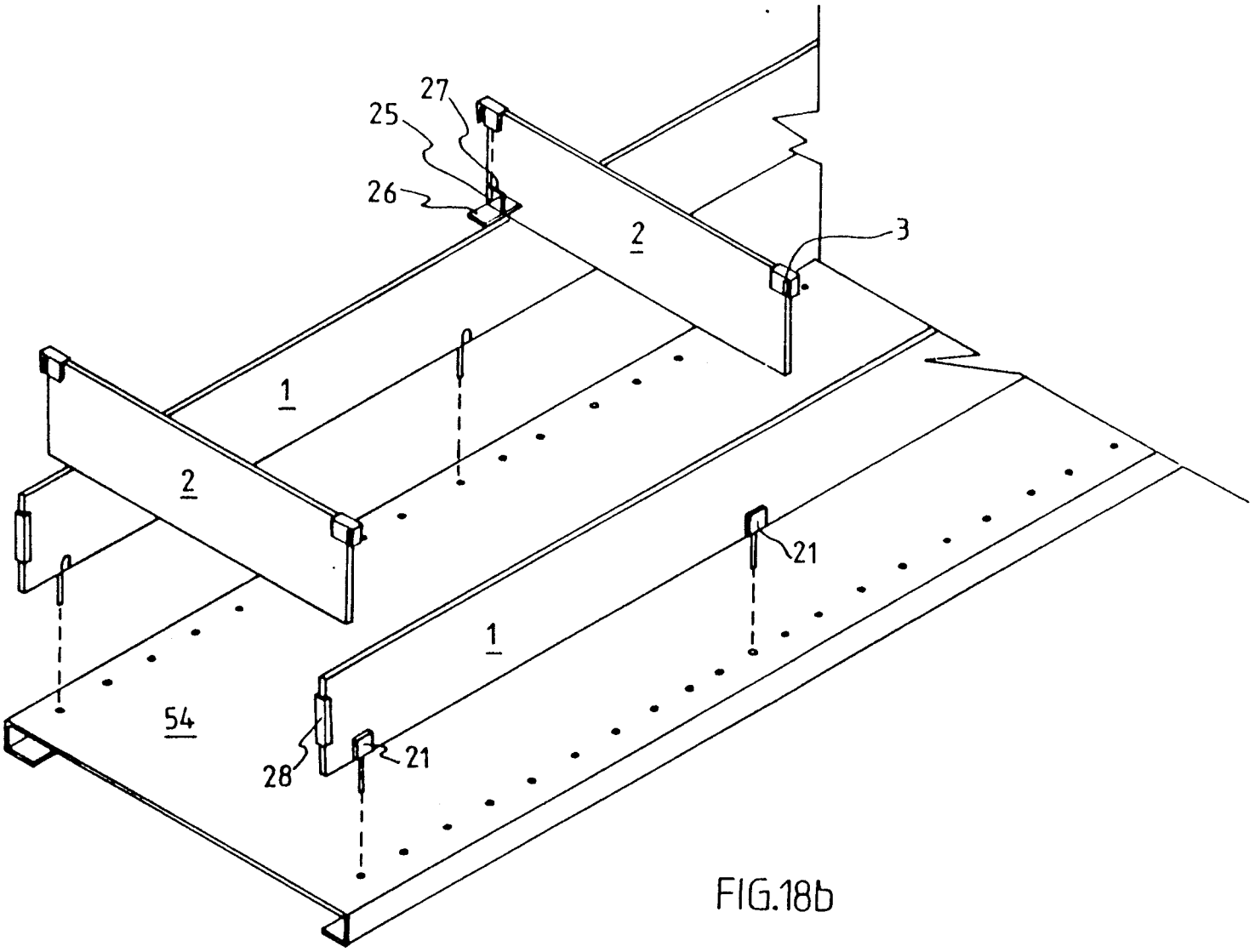
Figure 19A:
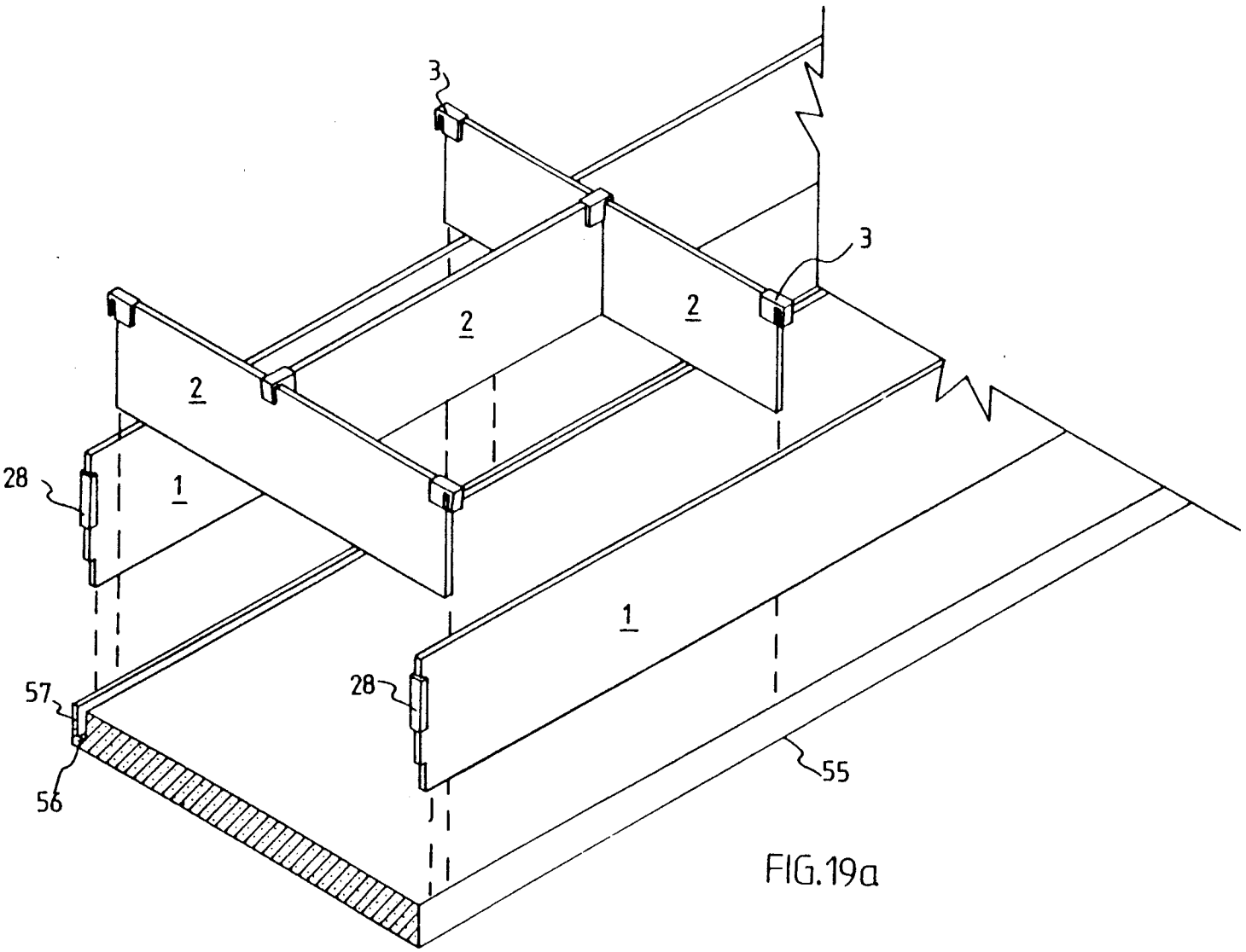
Figure 19B:
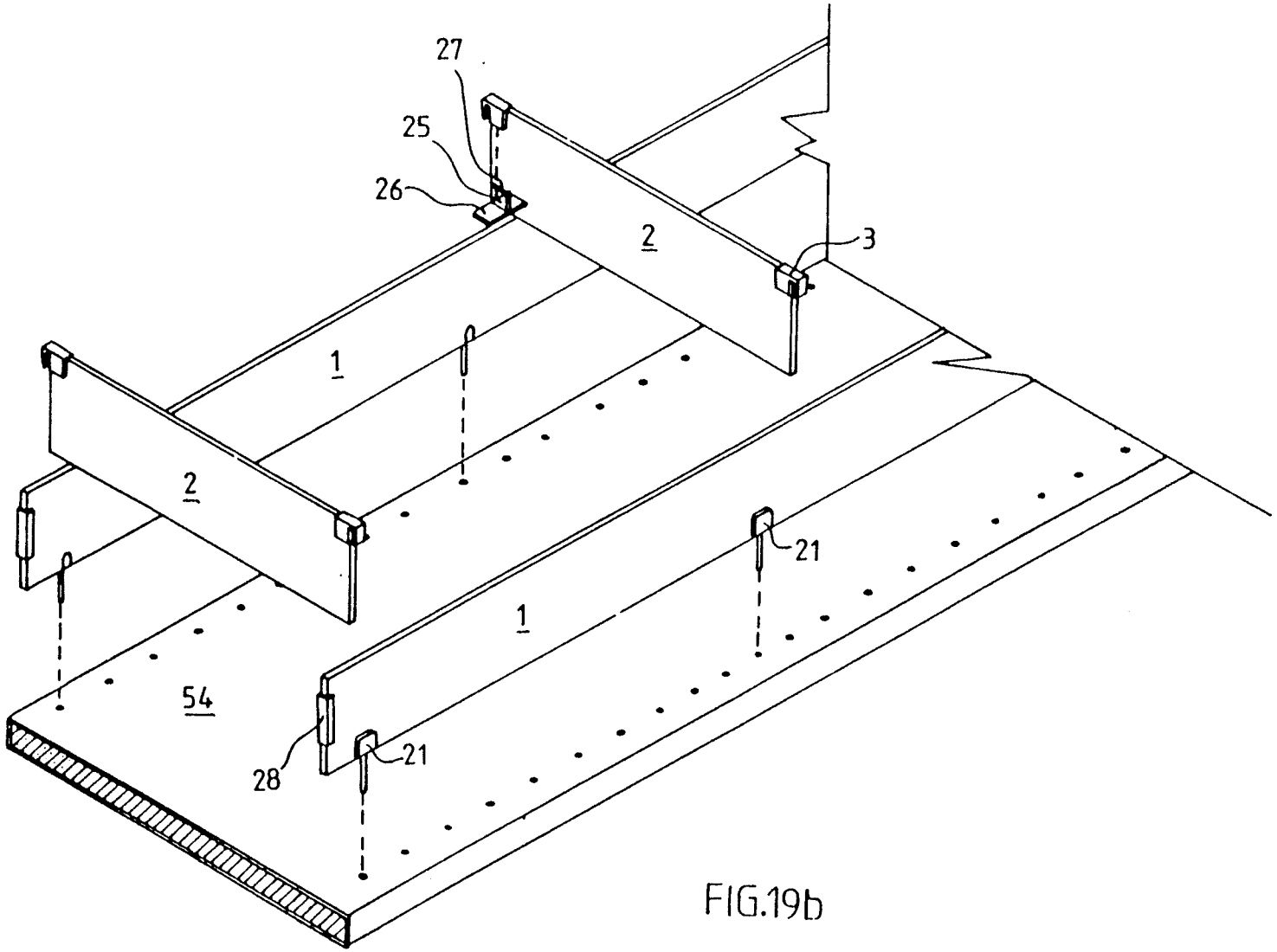
Figure 21:
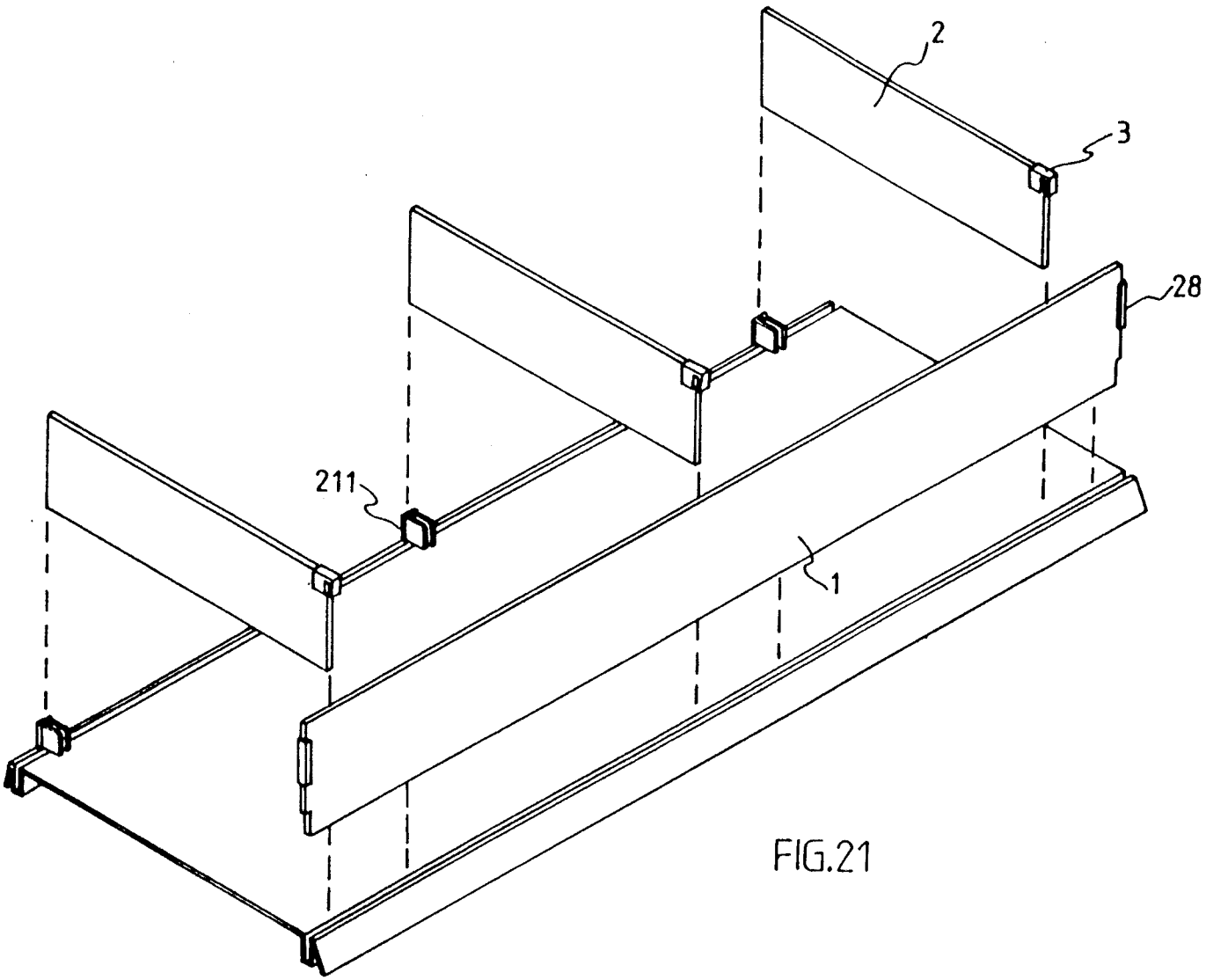
Figure 21B:
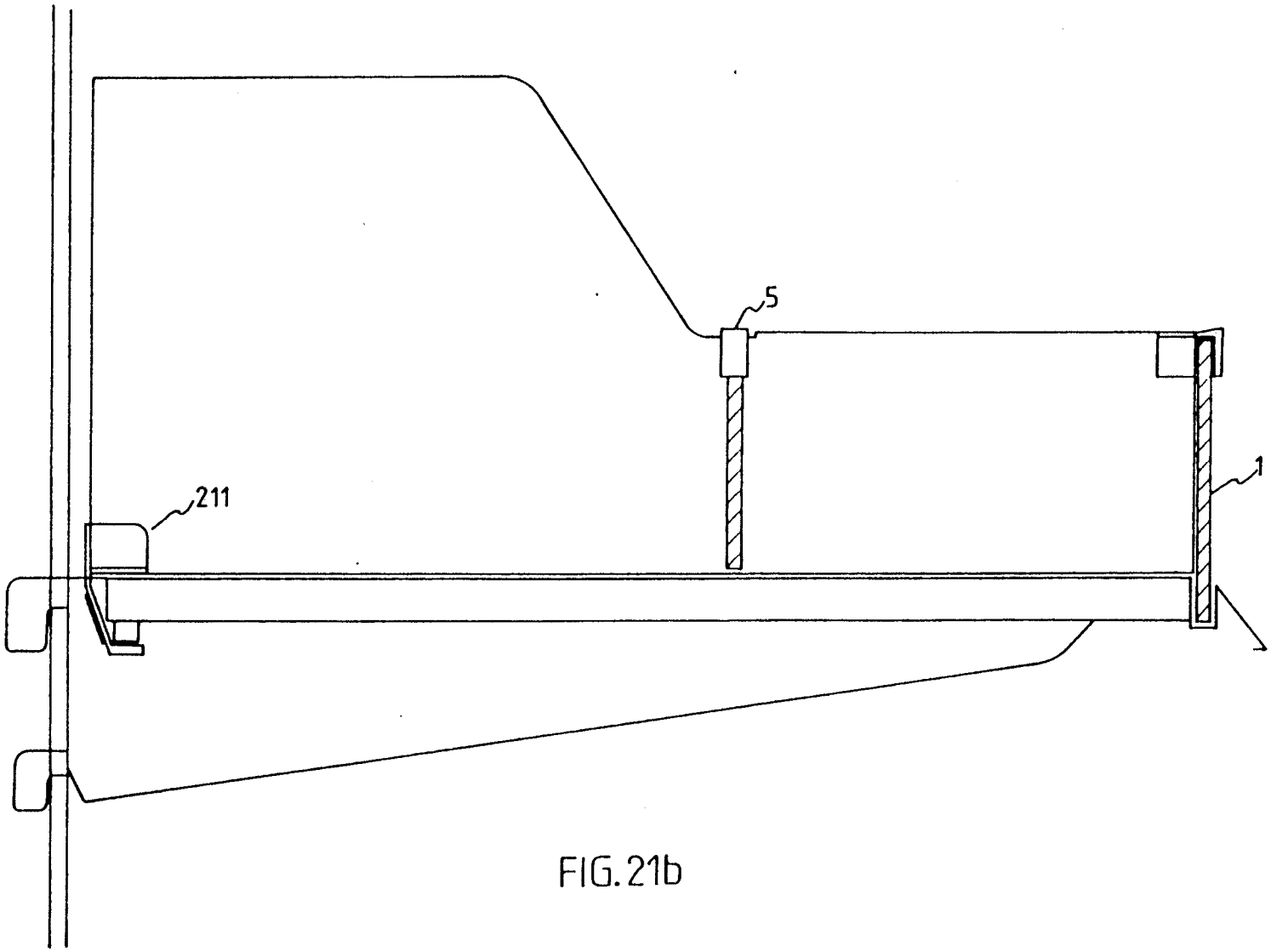
Figure 22A:
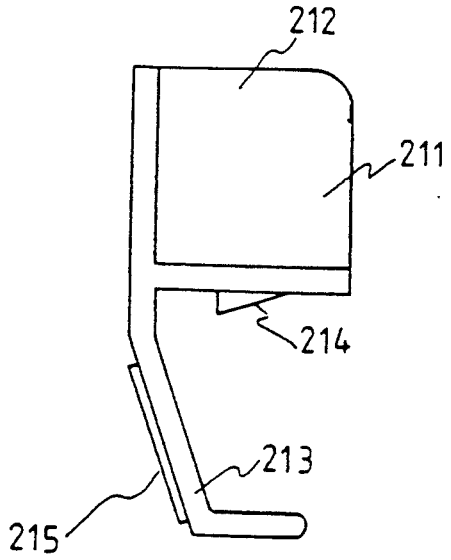
Figure 22B:
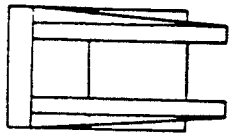
Figure 22C:
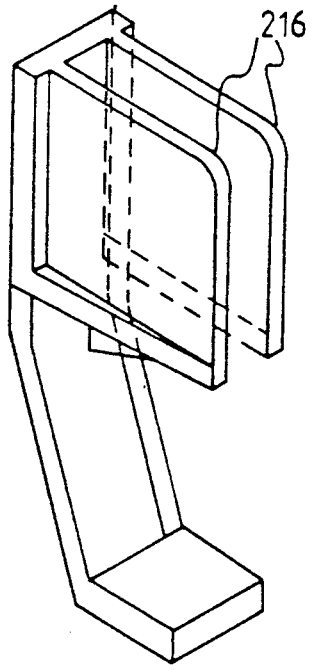
Figure 23A:
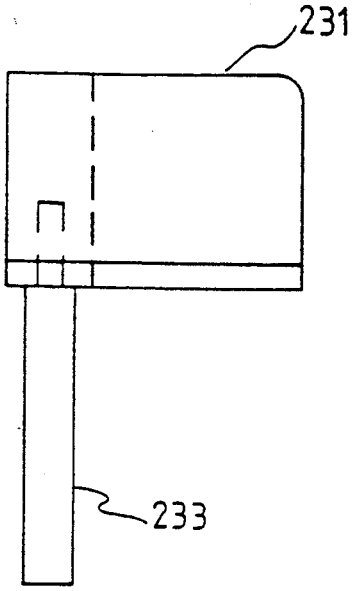
Figure 23B:
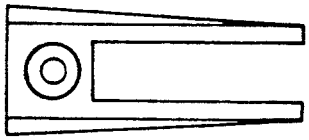
Figure 23C:
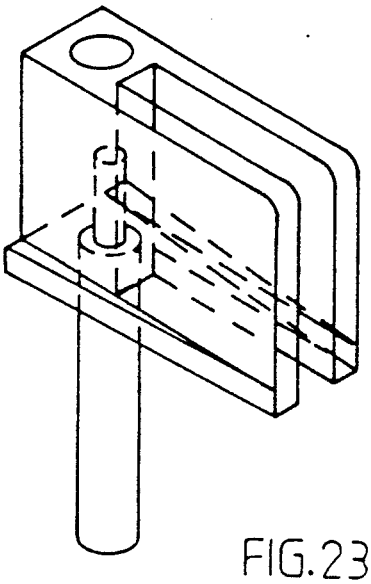
Figure 24A:
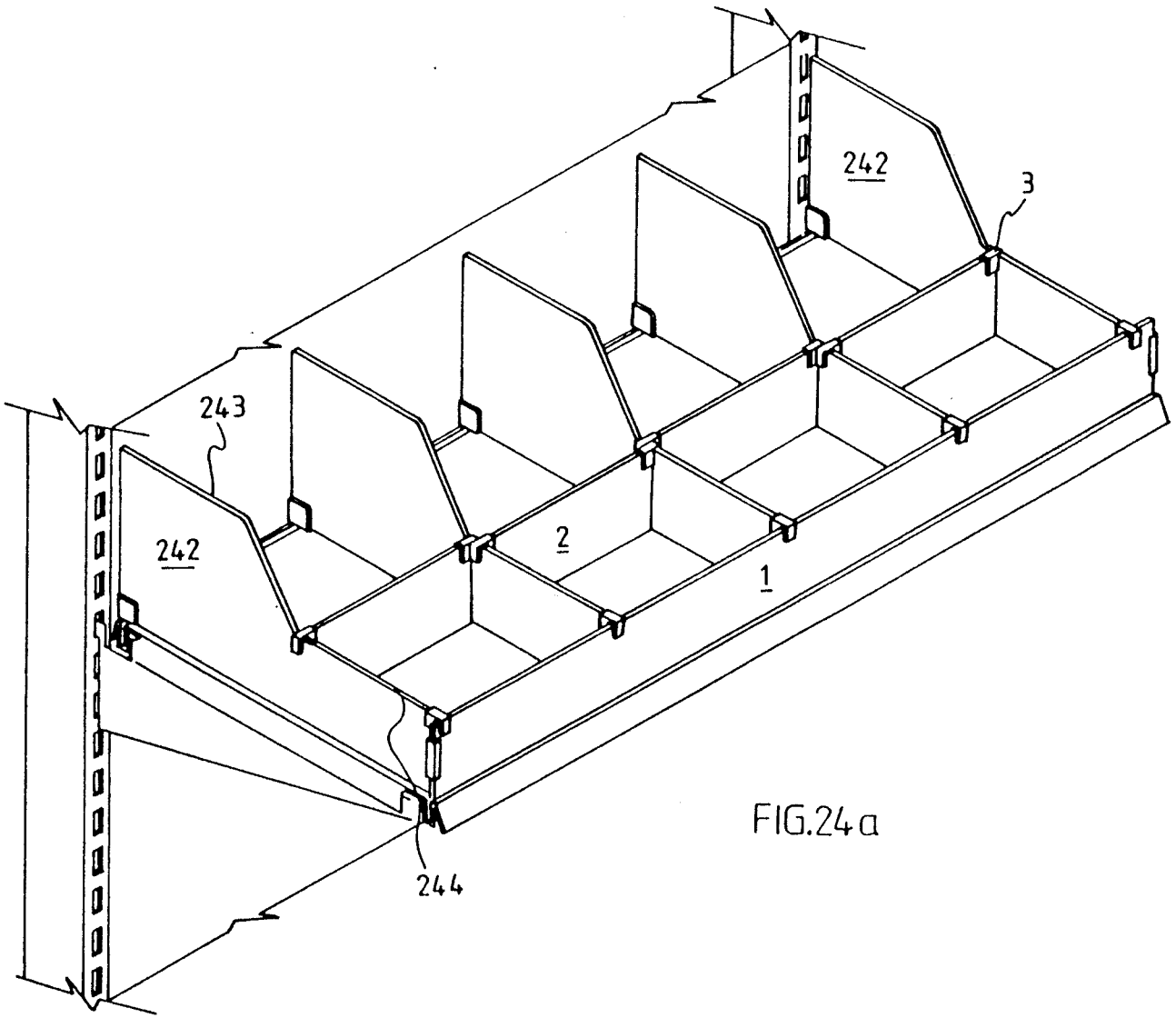
Figure 25A:
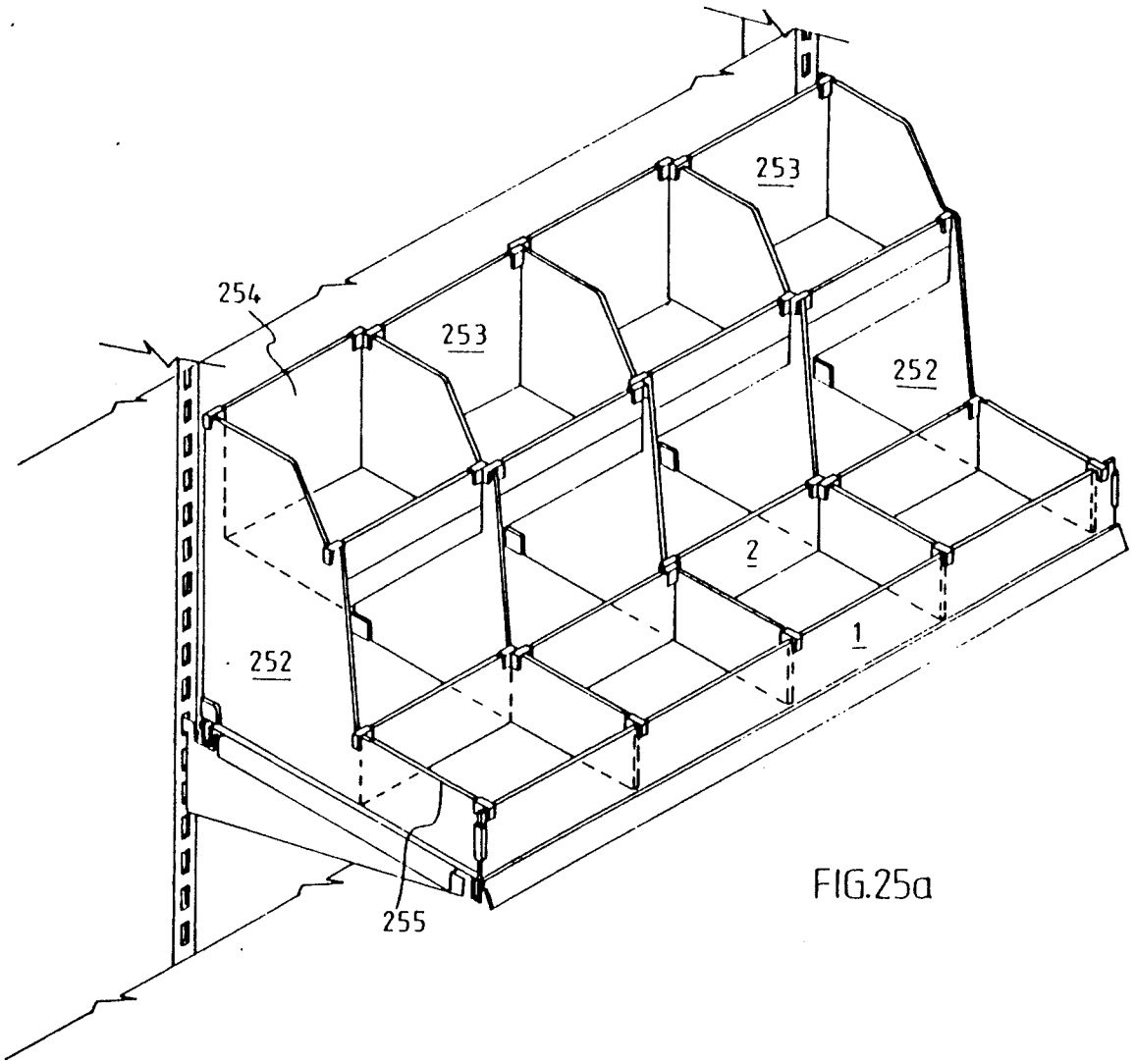
Figure 25B:
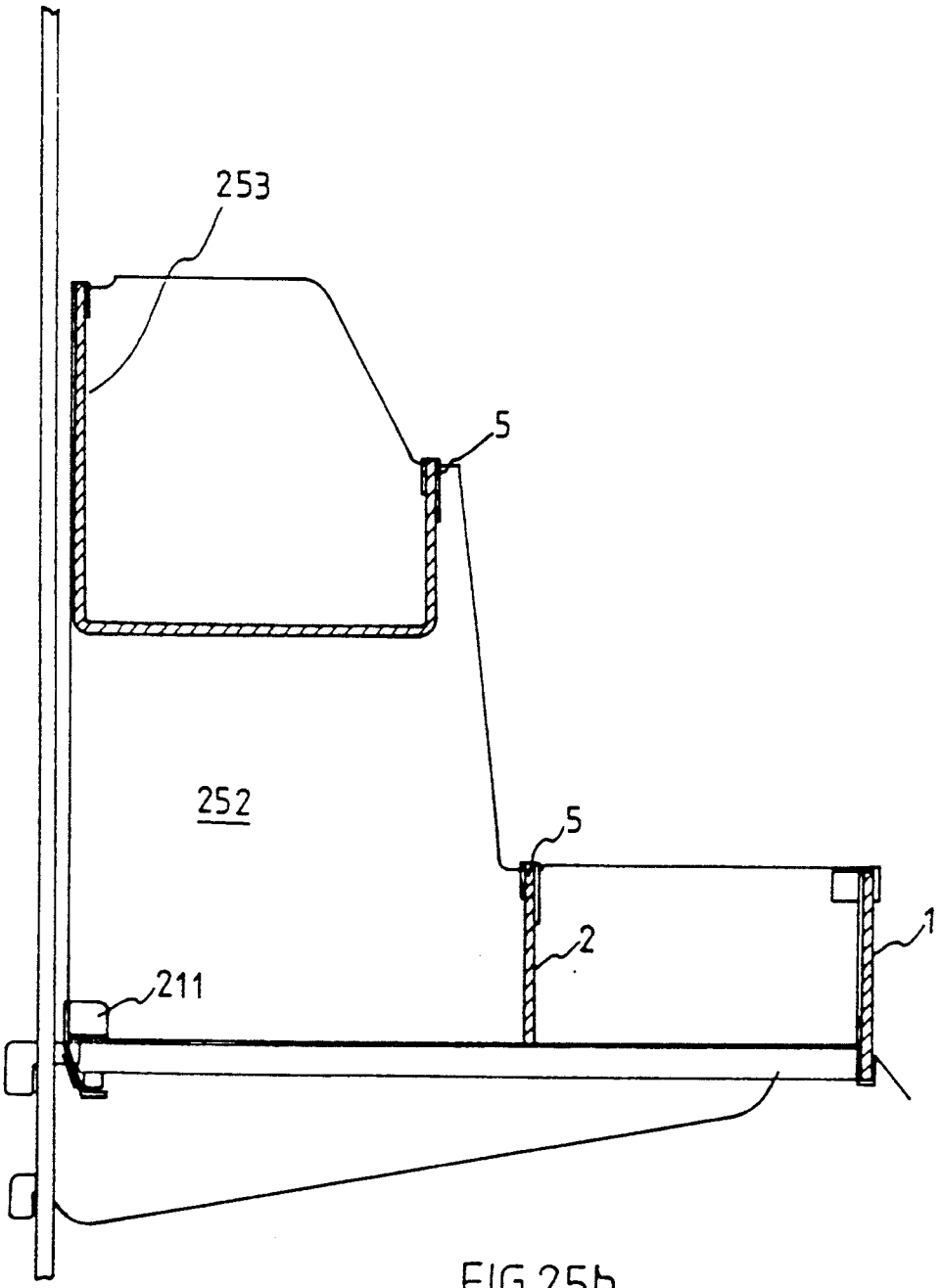
Figure 26A:
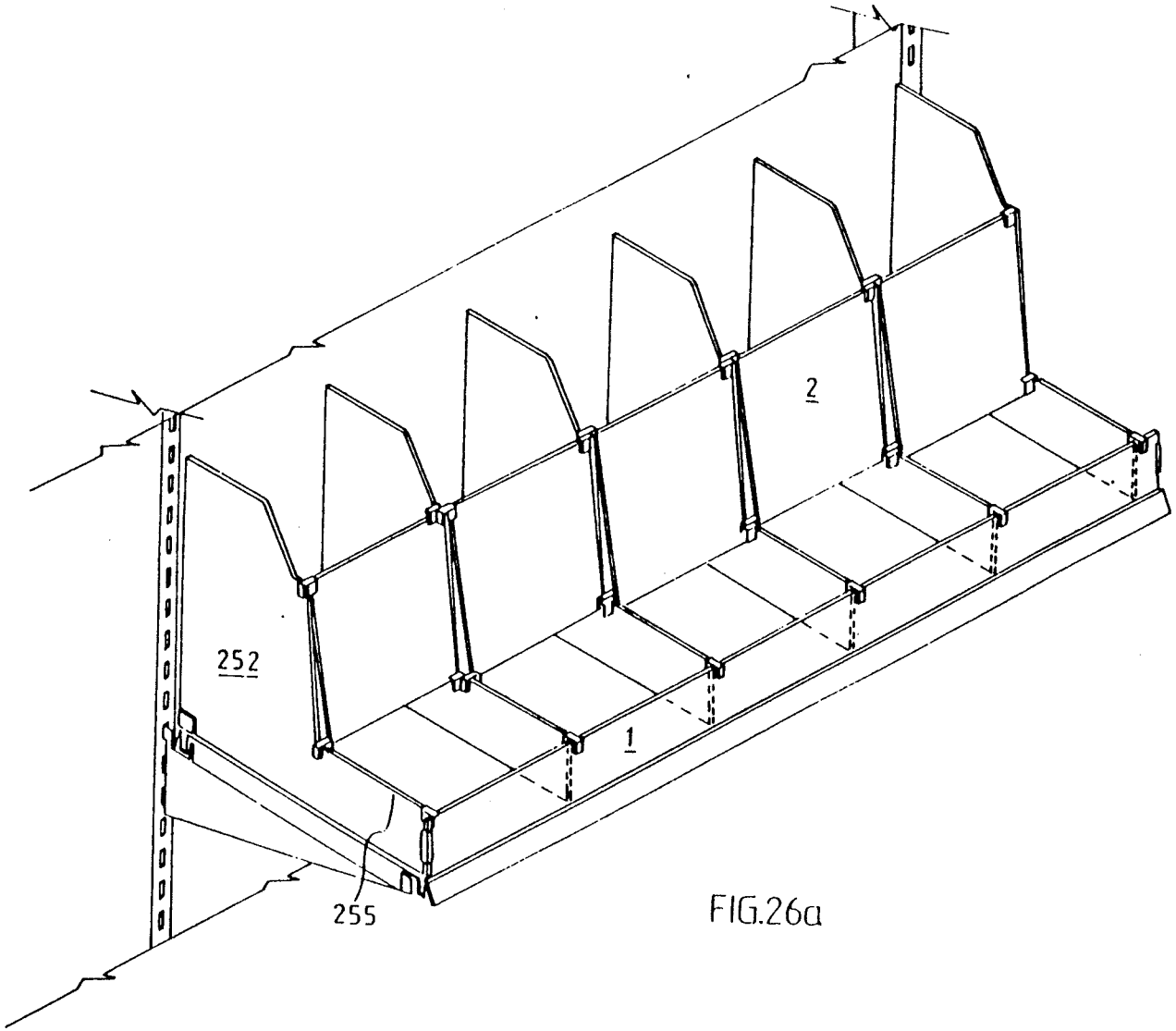
Figure 26B:
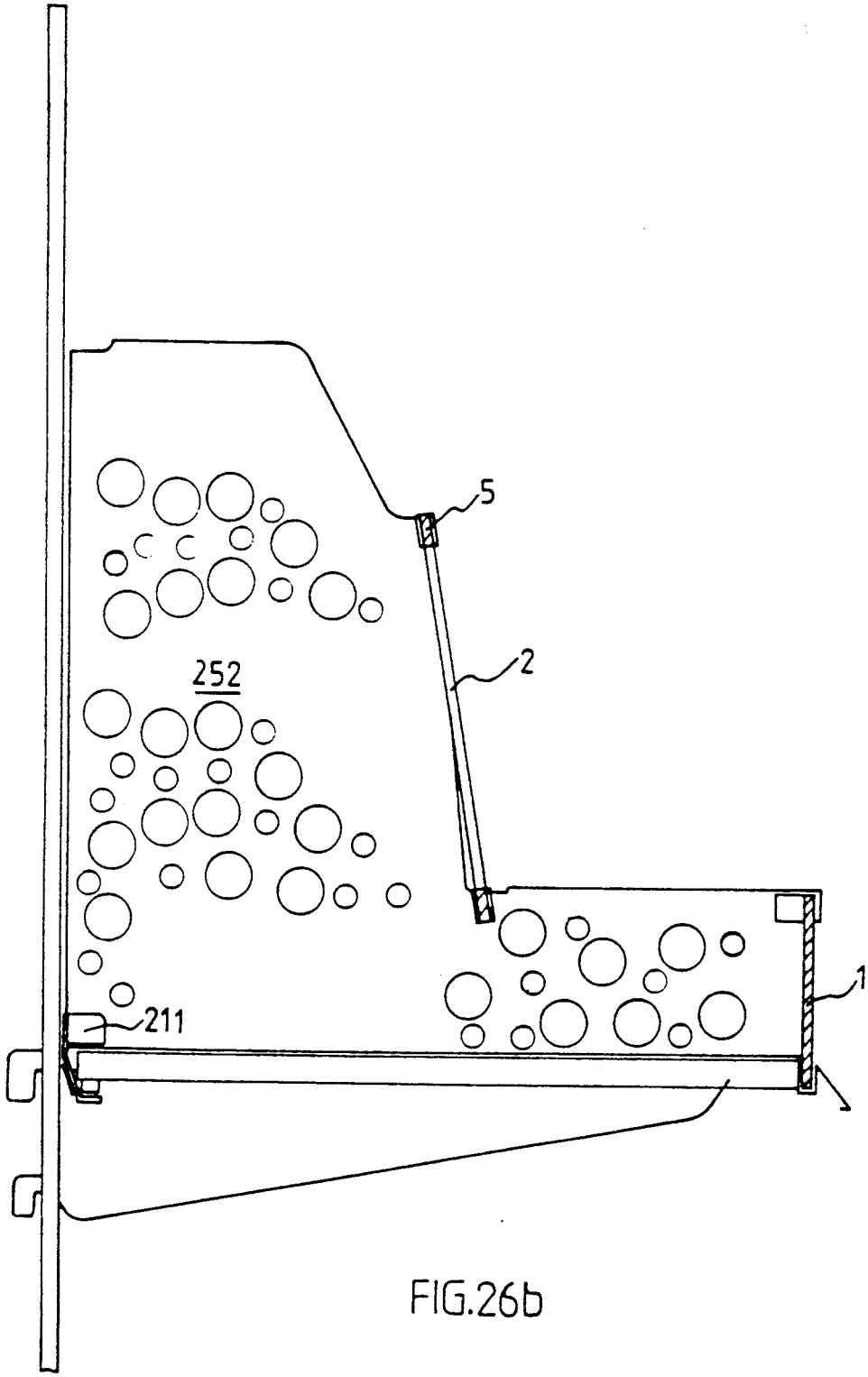
Figure 27A:
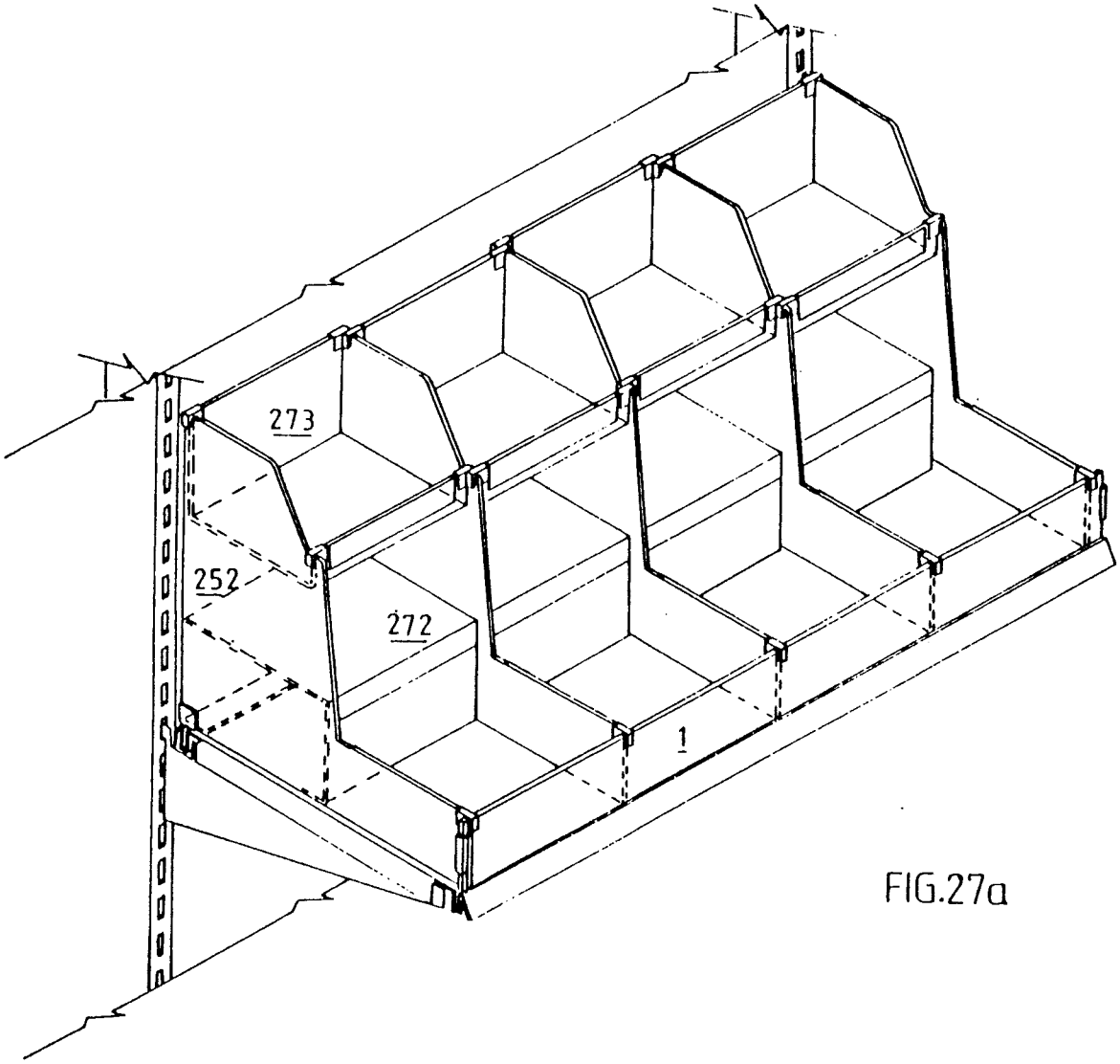
Figure 27B:
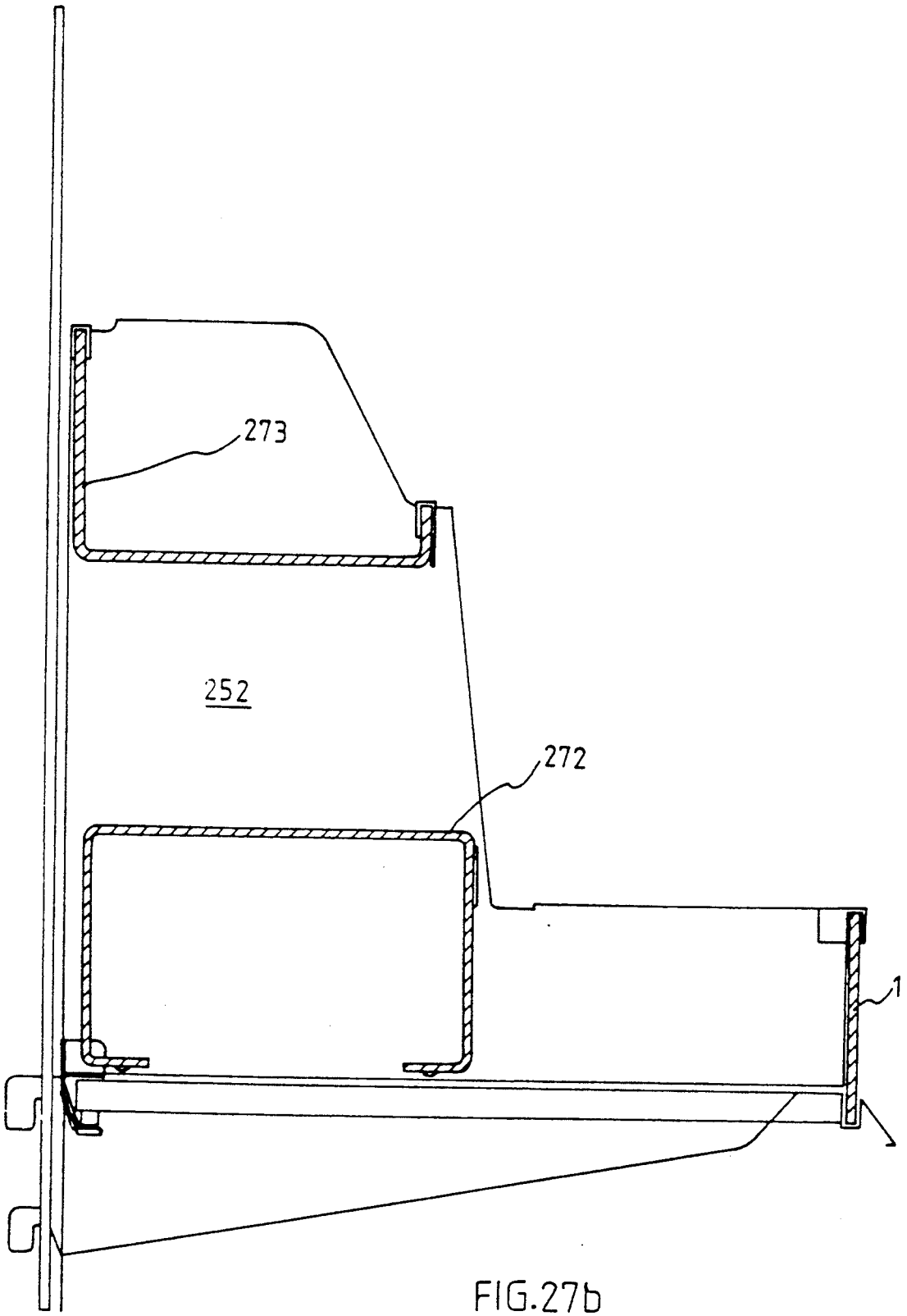
Figure 29:
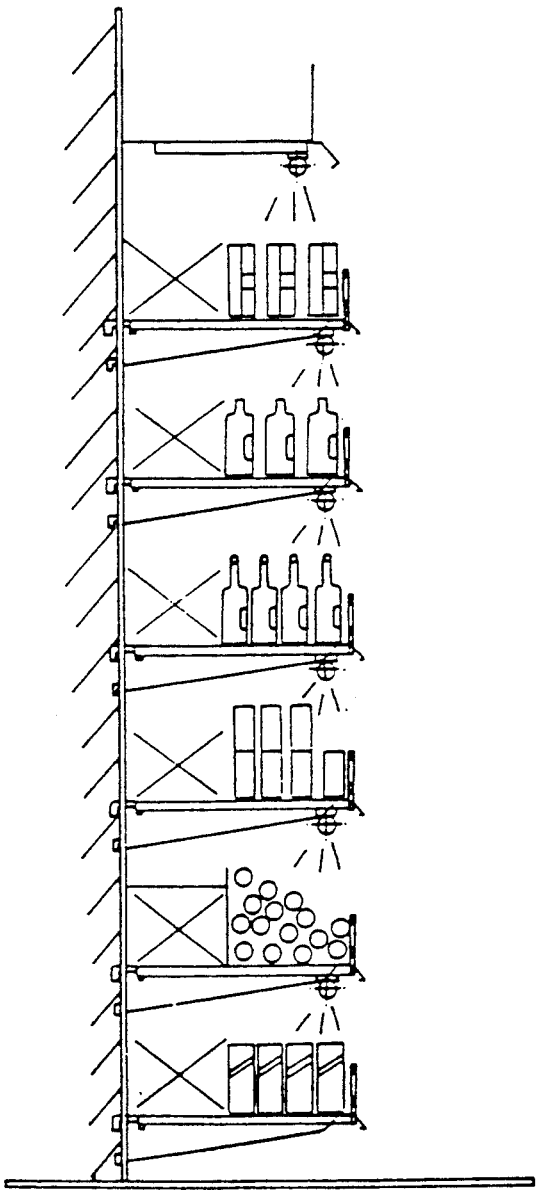
FIG.29 PRIOR ART
Figure 28:
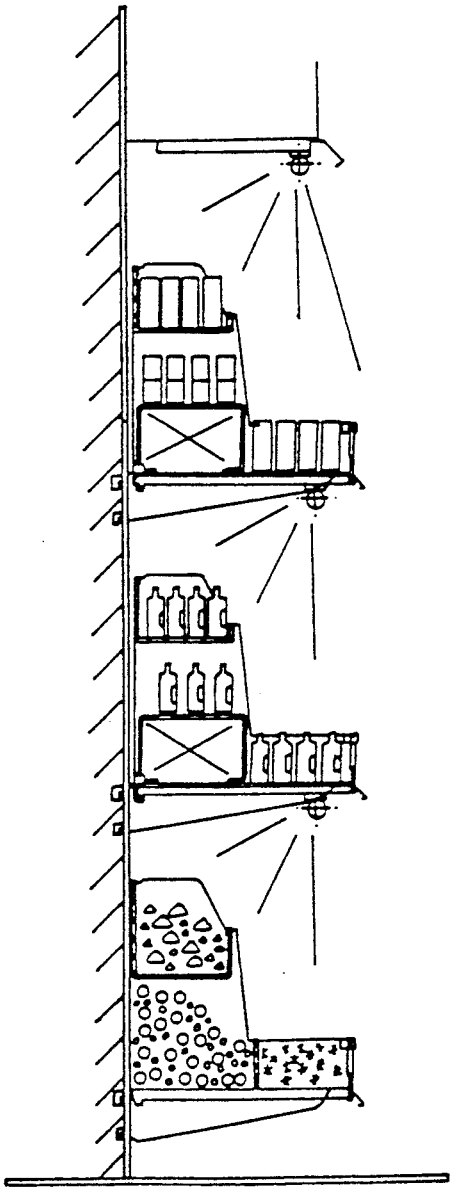

FIGS. 18*a* and 18*b* are perspective views of the riser and divider system showing the arrangement in use with metal shelving systems;

FIGS. 19*a* and 19*b* are perspective views of the riser and divider system showing the arrangement in use with timber shelving systems;

FIGS. 20*a*–20*d* are side views of the riser inserted for use with various existing metal and timber shelf types;

FIGS. 21 and 21*b* are an exploded perspective view of a further arrangement of a riser and divider system having no back riser;

FIGS. 22*a*, 22*b* and 22*c* are a side view, a plan view and an isometric view, respectively, of one embodiment of a support clip which forms part of the arrangement shown in FIG. 21;

FIGS. 23*a*, 23*b* and 23*c* are a side view, a plan view and a perspective view, respectively, of an alternative embodiment of support clip;

FIGS. 24*a* and 24*b* are a perspective view and a cross-sectional side view, respectively, of one riser and stepped divider arrangement;

FIGS. 25*a* and 25*b* are a perspective view and a cross-sectional side view, respectively, of a riser and divider binning arrangement;

FIGS. 26*a* and 26*b* are a perspective view and a cross-sectional side view, respectively, of a riser and divider hopper arrangement;

FIG. 27*a* and 27*b* are a perspective view and a cross-sectional side view, respectively, of a tiered level, riser and divider arrangement;

FIG. 28 is a cross-sectional view of a typical shop display with two tiered level arrangements as shown in FIG. 27 and a binning arrangement as shown in FIG. 25; and FIG. 29 is a cross-sectional view of a typical shop display using prior art shelving.

The principal components of the display apparatus will now be described.

Figure 1:
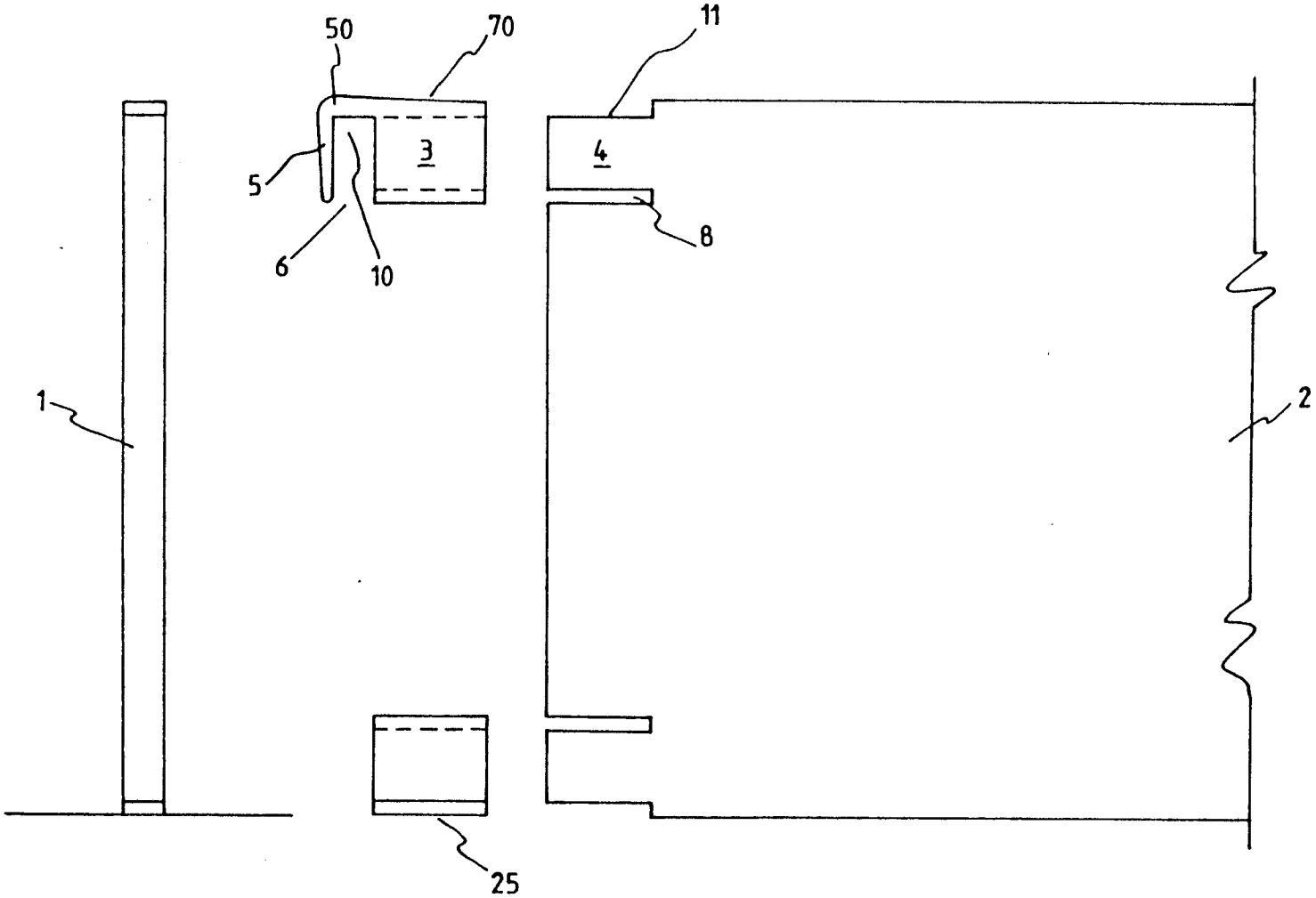
FIG. 1 is a schematic of the general arrangement of the divider connector components before assembly.
Figure 2:
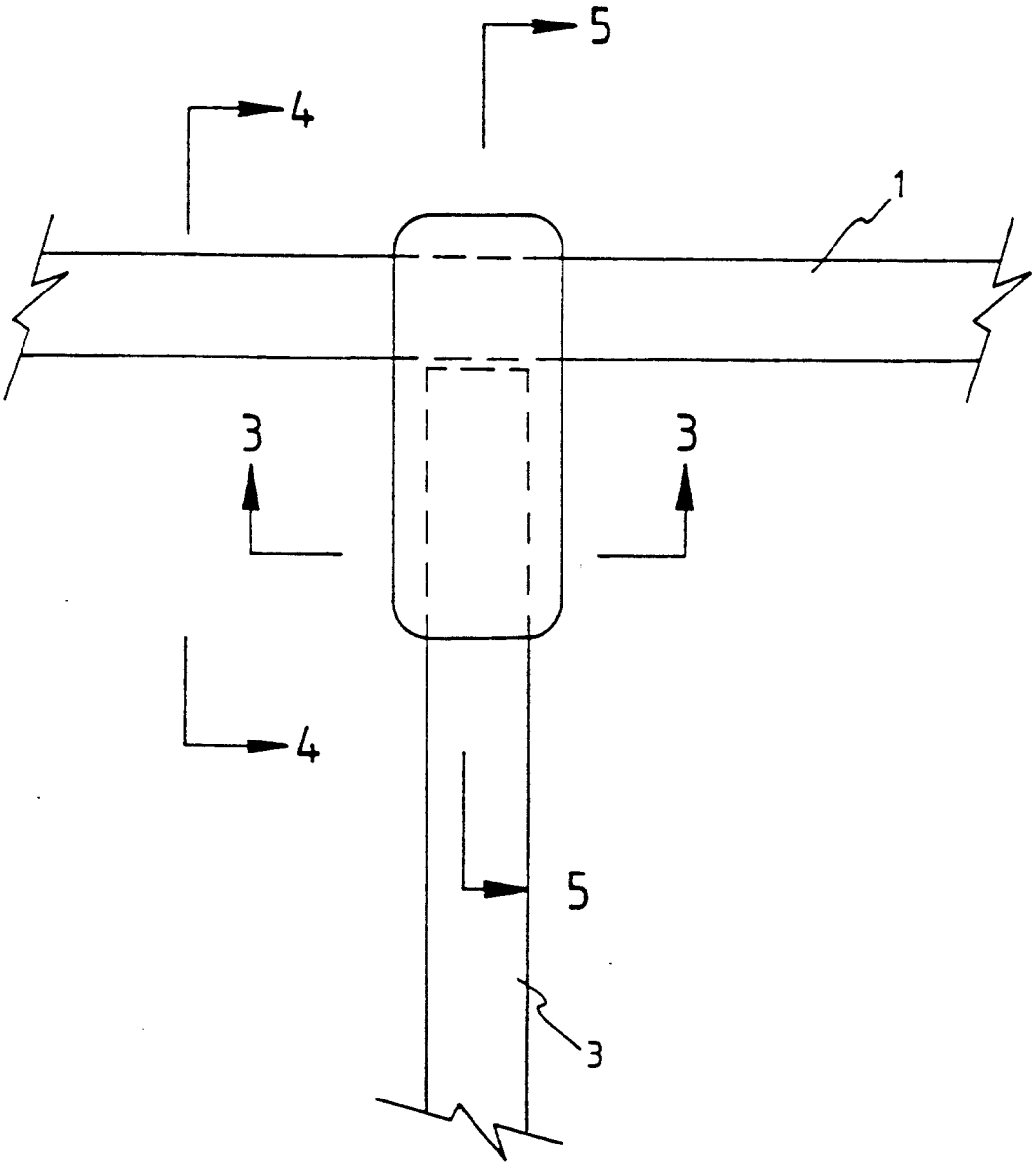
FIG. 2 is a plan view of a divider connector engaging a riser.
Figure 3:
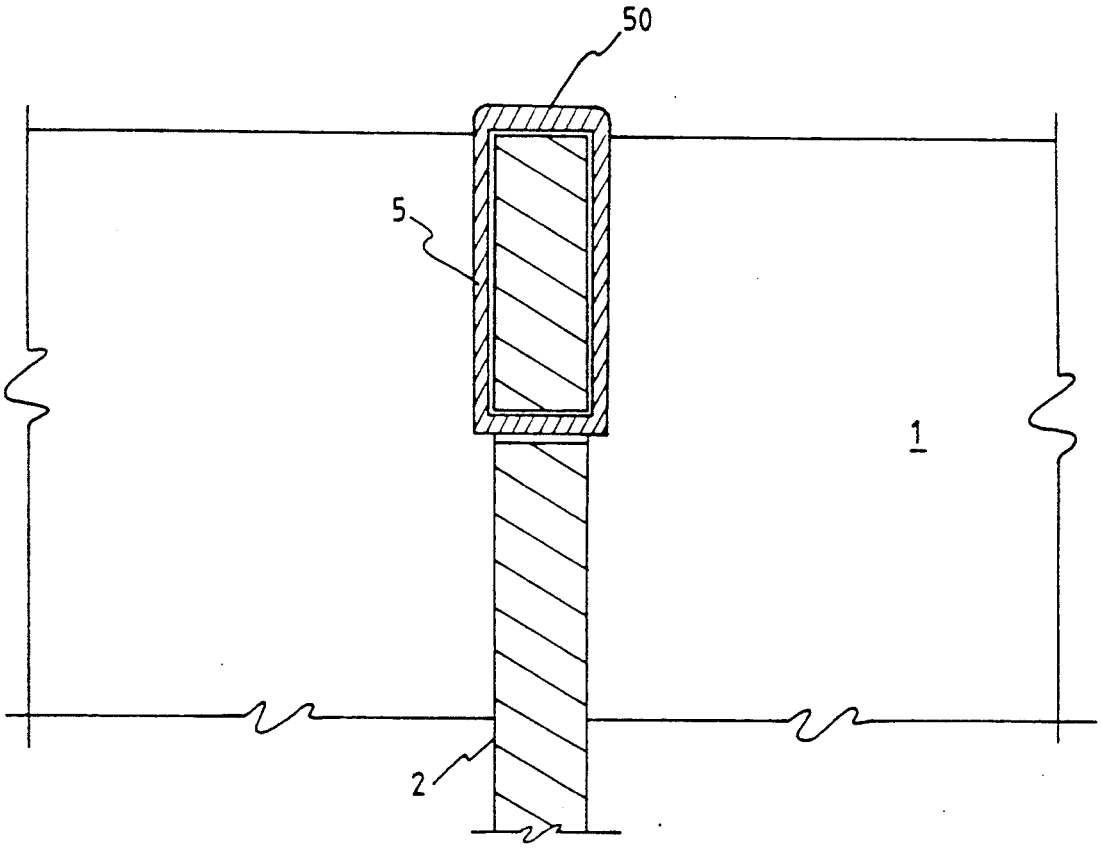
FIG. 3 is a sectional elevation along the line 3—3.

Referring initially to FIGS. 1, 2 and 3, the riser and divider system of the invention includes a riser 1, a divider 2, a divider connector 3 having a hook 5 thereon defining a mouth 6 leading into a gap 10, the width of mouth 6 being narrower than the width of gap 10. The dimensions of mouth 6 and gap 10 are complementary with the thickness of riser 1, the hook 5 may be slotted over the riser 1 thus providing for a secure clip-on arrangement. The top-face of the divider connector 3 is provided with an inclined cross sectional area leading to a reinforced portion 50.

The divider 2 is provided with a machined slot 8 and notch 11 defining a tongue 4 which is engagable with divider connector 3 by being pressed fitted. Because the thickness of the riser 1 is greater than the width of the mouth 6, the hook 5 is opened somewhat thus giving a secure fit.

Figure 4:
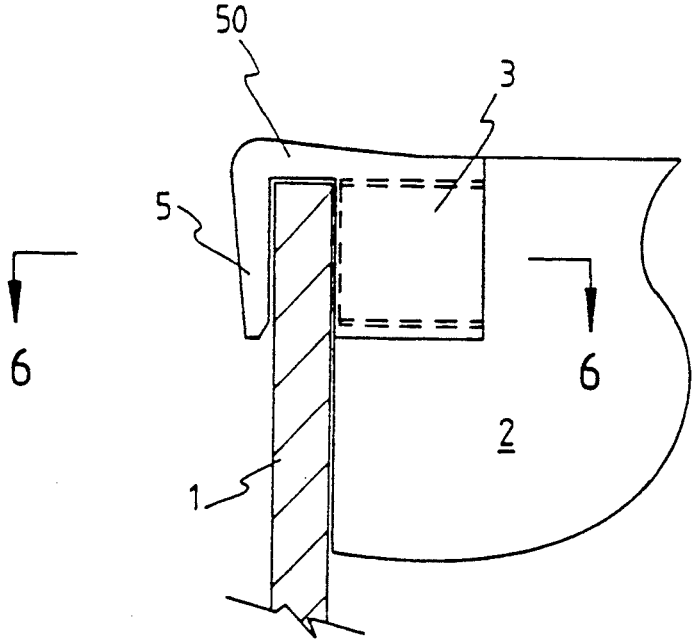
FIG. 4 is a sectional elevation along the line 4—4.
Figure 5:
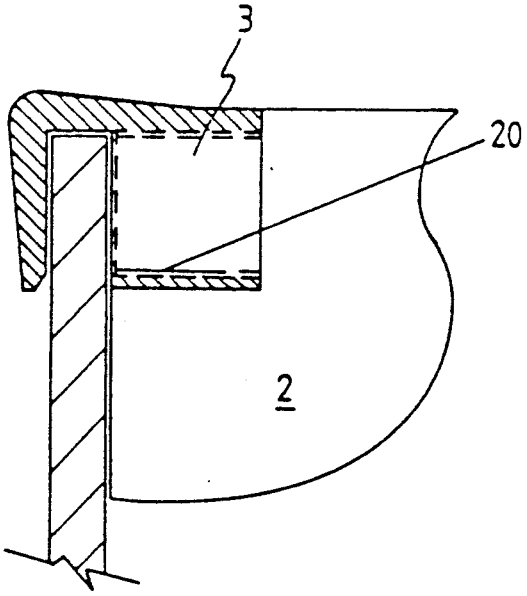
FIG. 5 is a sectional elevation along the line 5—5.
Figure 6:
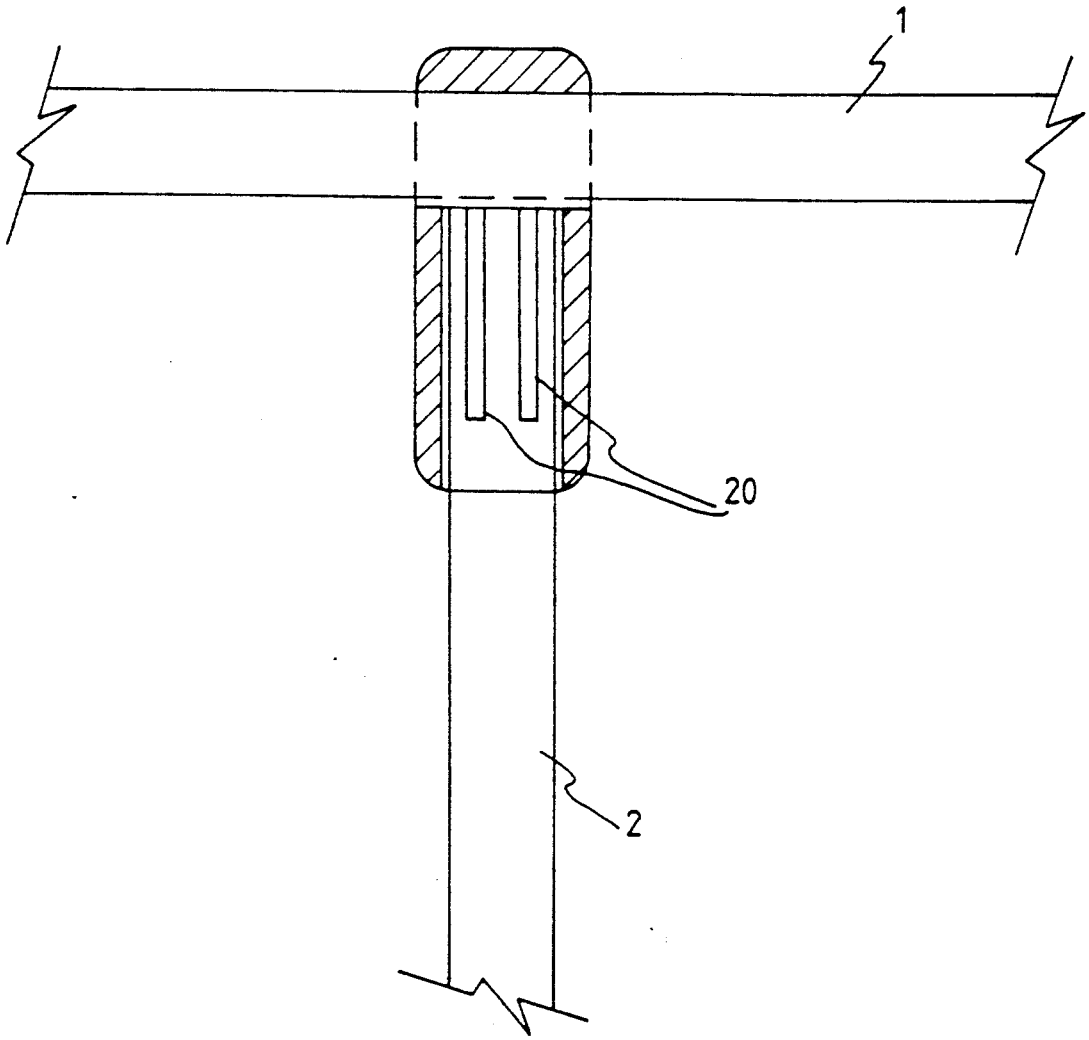
FIG. 6 is a sectional elevation along the line 6—6.

Referring to FIGS. 4, 5 and 6, the divider connector 3 has interference ribs 20, which do not extend along the entire length of the connector 3. The interference ribs 20 cooperate with the tongue 4 of the divider 2 and provide for a secure interference fit. Thus the tongue 4 is securely fixed in position inside the connector 3. The hook 5 may then be clipped onto the riser 1 thus allowing for connection of the divider 2 to the riser 1.

Figure 7:
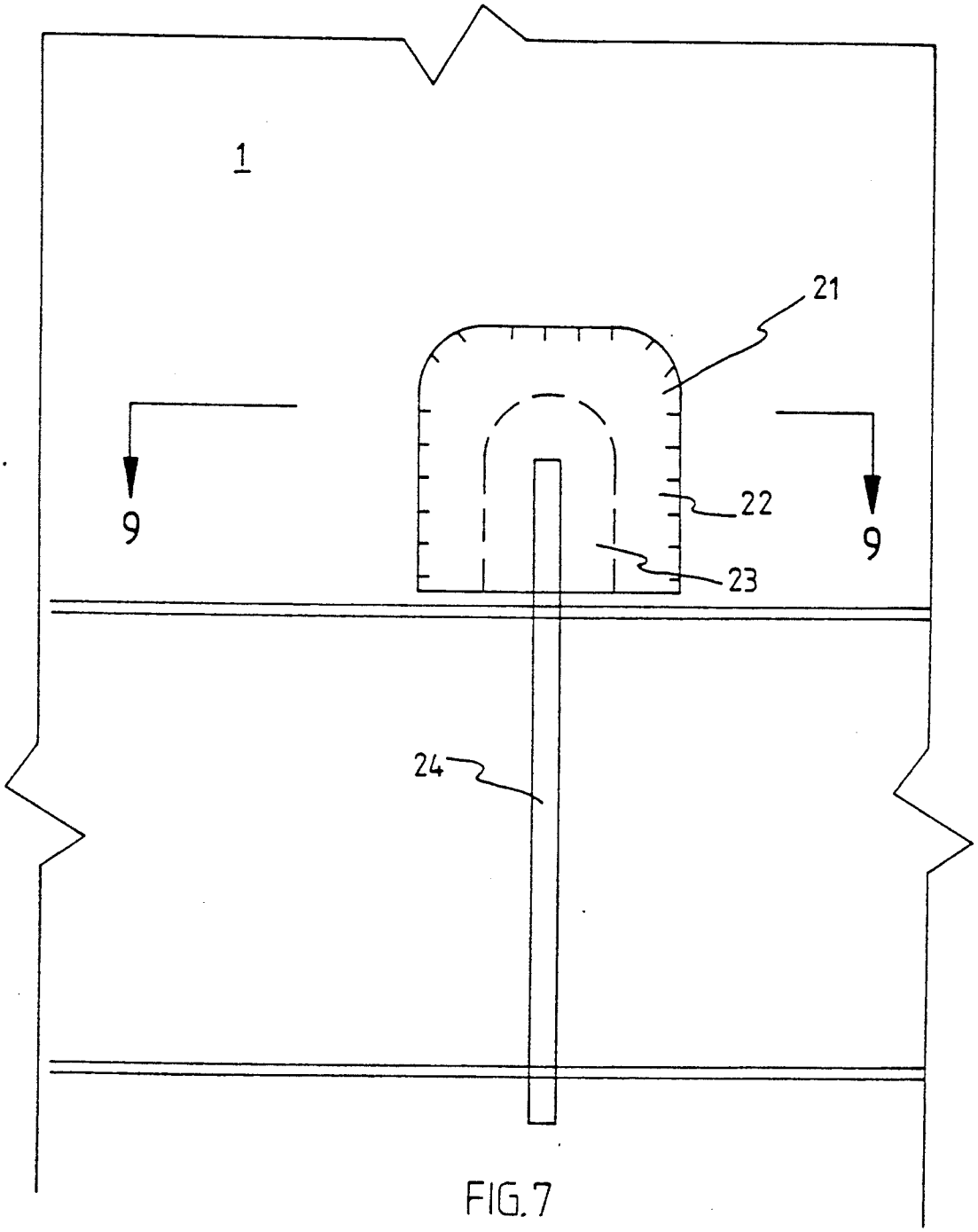
FIG. 7 is a sectional elevation along the line 7—7 of FIG. 9 showing the pinned riser-fixing component.
Figure 8:
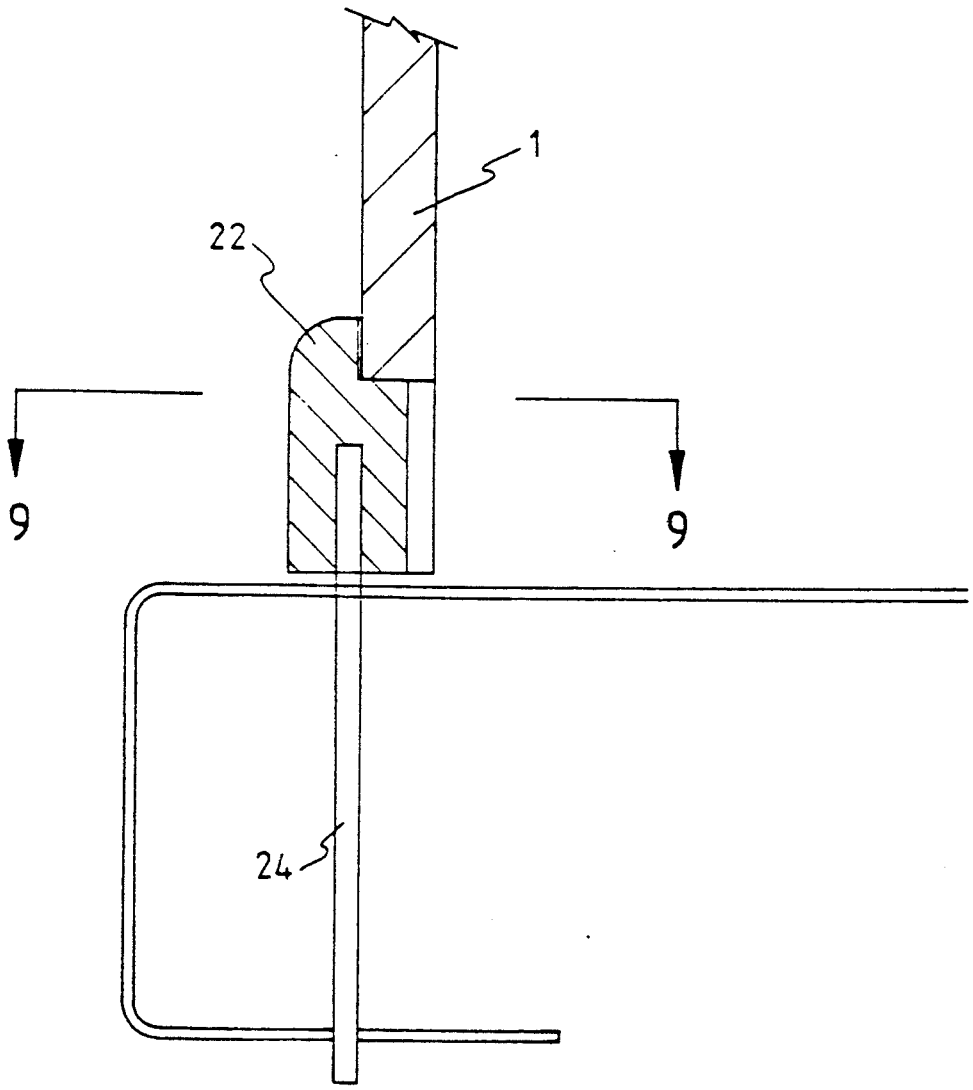
FIG. 8 is a sectional elevation along the line 8—8 of FIG. 9.

Referring now to FIGS. 7, 8 and 9 the pinned riser-fixing component 21 comprises a plug 22 having a shoulder 23 and a pin 24. The shoulder portion 23 is shaped such that it fits in the correspondingly shaped cut-out (shown dotted) of the riser 1. The plug 22 may be attached to the riser 1 by glue or the like means. The diameter of the pin 24 is chosen so that it will fit through holes provided in the particular shelf on which the system is to be mounted.

Figure 10:
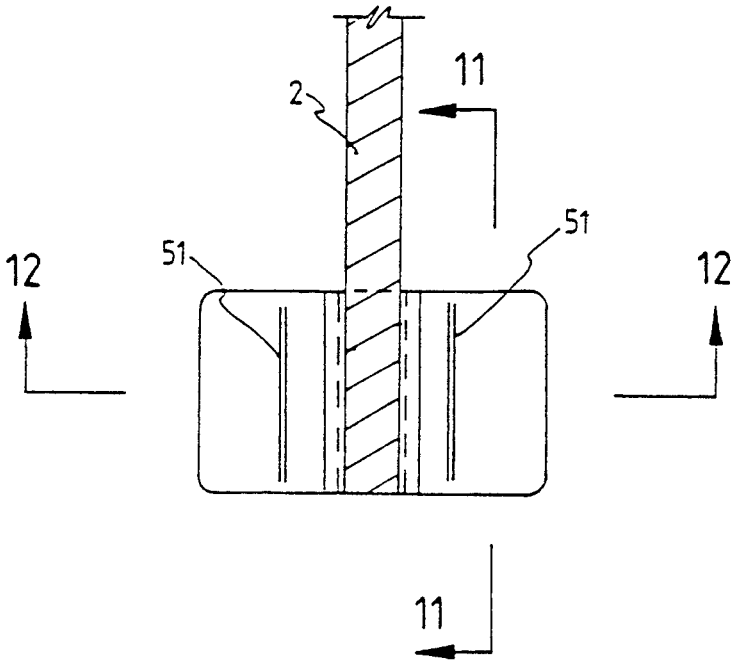
FIG. 10 is a sectional plan view along the line 10—10 of FIG. 12, showing the stabiliser component.
Figure 12:
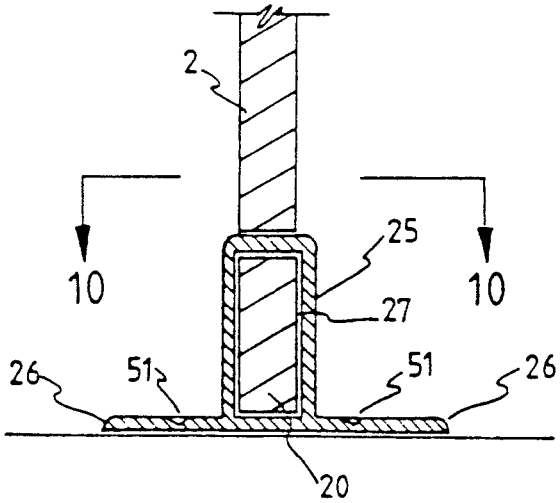
FIG. 12 is a sectional elevation along the line 12—12 of FIG. 10.
Figure 11:
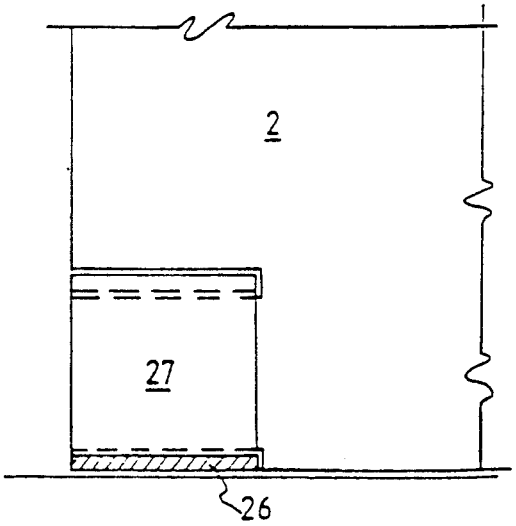
FIG. 11 is a sectional elevation along the line 11—11 of FIG. 10.
Figure 16:
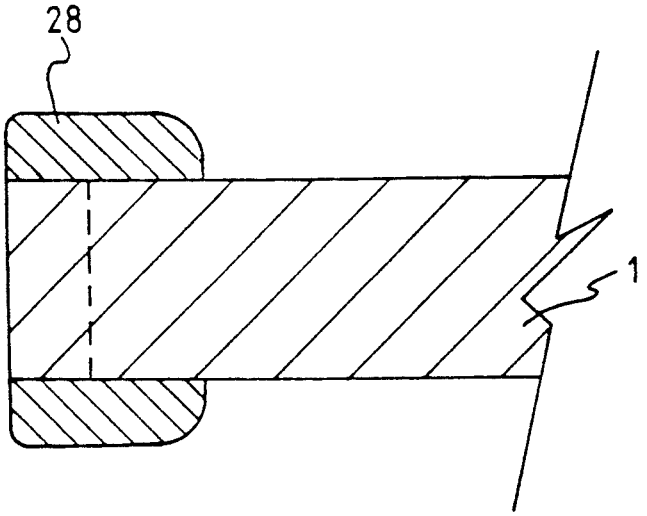
FIG. 16 is a sectional elevation along the line 16—16 of FIGS. 13, 14 and 15.
Figure 17:
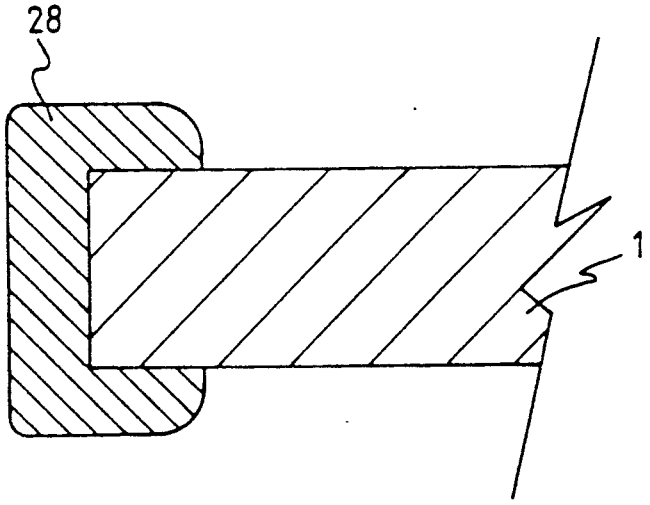
FIG. 17 is a sectional elevation along the line 17—17 of FIGS. 13, 14 and 15.

Referring now to FIGS. 10, 11 and 12, the stabiliser component 25 comprises a connector 27 having interference ribs 20 formed therein and having projecting feet 26 on each side of the connector 27. The stabiliser component 25 may be engaged with a tongue 4 (shown in FIG. 1) provided on the divider 2 in the same manner as the divider connector 3 engages with the tongue 4 as previously described. If required, one of the feet 26 may be broken off at the break-off line 51 provided on each foot, to facilitate the divider positioned at the end of the shelf.

Referring now to FIGS. 13, 14, 15, 16 and 17, the end stop component 28 comprises a sonic welded on component which is fitted securely into a notch provided on the end of the riser 1. The function of the end stop component 28 is to prevent a divider 2 (shown dotted) from slipping off the end of the riser 1.

Referring now to FIG. 18*a*, the assembled riser/divider arrangement is shown in combination with a metal shelf 53 having a channel 52 thereon. The front and back risers 1, sit into a channel 52 formed in the shelf 53.

In FIG. 18*b*, the assembled riser/divider arrangement is shown in combination with a punched, slotted or perforated metal shelf 54. In this case, the risers 1 are secured on the shelf 54 by means of the pinned plug riser fixing components 21, said components are fitted into the arcuate slots provided on the riser 1 and the pins 24 of the riser-fixing component 21 fits into the holes provided on the shelf.

In both FIGS. 18*a* and 18*b*, the dividers 2 are securely attached to the risers 1 by means of divider connectors 3. The strength of the assembled structure is further enhanced by having stabiliser components 25 attached to the dividers 2.

Referring to FIG. 19*a*, the assembled riser/divider arrangement is shown in combination with a wooden shelf 55 having a channel 56 thereon. The channel 56 may have a lining 57 therein. The lining may be fabricated from aluminum or plastics material or the like. The front and back risers 1, sit into the channel 56 formed in the shelf 55.

Referring to FIG. 19*b*, a drilled hole with or without a drive-fit plastic insert 30 is provided such that the pin 24 of the pinned riser-fixing component 21 fits therein and the plastic insert may be embedded in the timber shelf.

Referring to FIGS. 20*a*, 20*b*, 20*c* and 20*d*, the riser and divider system according to the invention may be used in combination with a multitude of shelf types which are presently in production for use in shops and retail outlets without need for any costly adaptations or alterations.

Figure 20A:
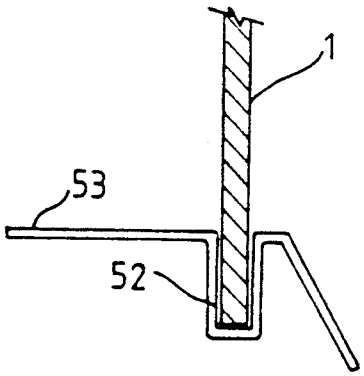

FIG. 20*a* shows the arrangement of the riser 1 slotted into the channel provided on the metal shelf.

Figure 20B:
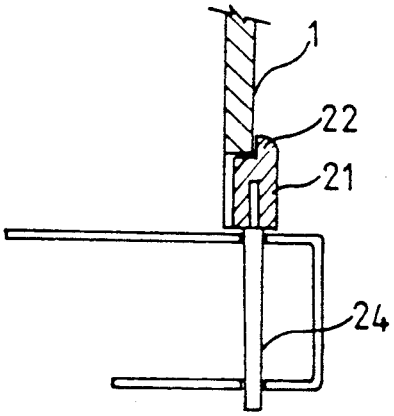

FIG. 20*b* shows the pinned riser-fixing component 21 in position on the riser 1, the component 21, being inserted securely in a hole provided on the punched, slotted or perforated metal shelf.

Figure 20C:
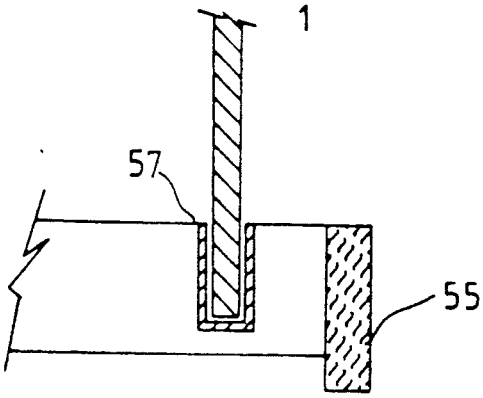

FIG. 20*c* shows a riser 1 inserted in a slot in the timber shelf, the slot being lined with aluminum or plastics extrudate or the like.

Figure 20D:
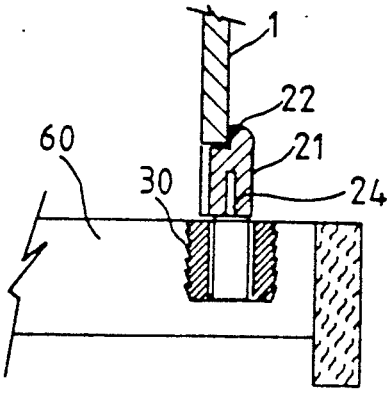

FIG. 20*d* shows the pinned riser-fixing component 21 sheathed in a drive-fit plastics insert 30, with the insert embedded in the timber shelf.

Referring now to FIG. 21, a riser and divider arrangement is shown in which a back riser is not included. A support clip 211 is included instead so as to receive and support the divider 2. Referring to FIGS. 22*a*, 22*b* and 22*c*, the support clip 211 includes a riser/-divider lower corner receiving element 212, a mounting limb 213, teeth 214 and stengthening ribs 215. The mounting limb 213 is designed to clip on a channel edge shelf. The teeth 214 assist in preventing rotation of the support clip 211. The corner receiving element 212 includes pair of wings 216. The wings 216 taper inwardly towards each other, thereby allowing for secure gripping of the corner of the divider 2 between the wings 216.

Referring to FIGS. 23*a*, 23*b* and 23*c*, a support clip 231 is shown, the mounting limb 233 of which is suitable for use with a perforated edge shelf.

Referring now to FIGS. 24*a* and 24*b*, a stepped divider arrangement is shown comprising main divider 242, cross dividers 2, front riser 1 and support clip 211.

The main divider 242 comprises a flat sheet of material, two edges 243, 244 of which are flat and one edge being of an irregular shape and being contiguous to the flat edges 243, 244. A connector 3 affixed to a cross divider 2 may be clipped onto the irregular edge of the divider 242 and the stepped divider arrangement may be achieved.

Referring now to FIGS. 25*a* and 25*b*, a binning arrangement is shown comprising main divider 252, cross divider bin 253 and front riser 1. The main divider 252 includes two flat edges 254, 255 and two irregularly shaped edges contiguous to the flat edges 254, 255. A connector 3 affixed to the cross divider bin 253 and another connector 3 affixed to a cross divider 2 may be clipped onto the respective irregular edges of the main divider 252 thereby allowing the binning arrangement to be achieved.

Referring to FIGS. 26*a* and 26*b*, a hopper arrangement is shown. The main divider 252 is included in the arrangement, together with a cross divider 2.

Referring now to FIGS. 27*a* and 27*b*, a tiered level arrangement is shown. This arrangement includes the main divider 252, a cross divider shelf 273 and a box divider 272.

Referring to FIGS. 28 and 29, the advantages of the riser and divider system of the present invention are demonstrated. In the prior art shelving arrangement, six display facings are provided together with six void spaces and six light sources are required. However, the present riser/divider system provides nine display facings with only two void spaces, requiring only three shelves and three light sources.

I claim:

1. A riser and divider system for a display apparatus, including at least one riser and at least one divider, each of which comprises a rigid sheet of plastics material, and a connector for disengagably connecting together the riser and divider, the connector comprising securing means for permanent fixing the connector to one of the riser and divider and engaging means for disengagably connecting the connector to the other of the riser and divider, further in which one of the riser and divider includes an integrally formed receiver element, said receiver element comprising a tongue, the securing means of the connector includes a socket fixable to the said receiver element tongue and the disengagable engaging means of the connector includes a clip element, further in which one of the riser and divider includes an integrally formed receiver element, said receiver element comprising a tongue, the securing means of the connector includes a socket fixable to the said receiver element tongue and the disengagable engaging means of the connector includes a clip element.

2. A riser and divider system as claimed in claim 1, in which the clip element comprises a resilient hook member which is adapted to grip the other of the riser and divider.

3. A riser and divider system as claimed in claim 2, in which the resilient hook member is spaced from the socket so as to define a gap which in its relaxed state narrows progressively from its closed end to its open end so as to provide a tight grip on the rigid sheet of material located in the gap.

4. A riser and divider system as claimed in claim 3, in which the resilient hook member, when viewed from one side approximates to the shape of the numeral "7", the short arm of the "7" being contiguous with a wall of the socket, with the cross-sectional thickness of the hook member progressively decreasing from the junction of the short arm and long arm of the "7" towards their ends, and with the cross-sectional thickness of the portion of said wall of the socket adjoining the end of the short arm of the "7" being thicker than the portion of said wall of the socket remote from the short arm of the "7", thereby giving the hook member a strong construction and whereby when a force is applied to the hook member, stress is spread along the arms of the "7" and the hook member tends to disengage from the sheet of material rather than break.

5. A riser and divider system as claimed in claim 4, in which the connector is manufactured from a high strength plastics material, such as polycarbonate, which is stronger than the rigid sheet of plastics material.

6. A riser and divider system as claimed in claim 1, including a plug member, a first portion of which is engageable with one of the riser and divider and a second portion of which is provided with a pin or projection engagable with a complementary receiver provided on the display surface.

7. A riser and divider system as claimed in claim 6, in which a formation is provided in the relevant riser or divider, the formation being engagable with the first portion of the plug member.

8. A riser and divider system as claimed in claim 7, in which the formation is a slot and the first portion of the plug member comprises a shoulder of complementary shape to the slot.

9. A riser and divider system as claimed in claim 1, including an end stop member engagable with an end of the riser or divider, said riser or divider including a formation to accommodate the end stop in a manner which substantially does not add to the overall length of the riser or divider.

10. A riser and divider system as claimed in claim 1, including a support clip which comprises a riser/divider lower corner receiving element and a mounting portion mountable on or about the display surface.

11. A riser and divider system as claimed in claim 1, including a stabilising element which comprises a securing means for fixing the element to one of the riser and divider and at least one foot for resting on a display surface and thereby stabilising the riser/divider.

12. A riser and divider system as claimed in claim 1, in which the sheet of material constituting one of the riser and divider includes at least one bend parallel to one of its edges so as to provide at least two flat surfaces at an angular relationship to one another, whereby the riser/divider may be in the form of a bin, bin divider, hopper or other three dimensional shape.

13. A riser and divider system as claimed in claim 1, in which the sheet of material constituting one of the riser and divider is a flat sheet of material, two edges of which are flat and with at least one edge contiguous to said flat edges being of an irregular shape, whereby a plurality of such sheets of material may be used to form stepped, tiered or other multi-level displays.

* * * * *

UNITED STATES PATENT AND TRADEMARK OFFICE

CERTIFICATE OF CORRECTION

PATENT NO. : 5,314,081

DATED : May 24, 1994

INVENTOR(S) : Francis A. Carroll

It is certified that error appears in the above-identified patent and that said Letters Patent is hereby corrected as shown below:

On sheet 16 of the drawings, "FIG. 21" should be --FIG. 21a--.

Col. 4, line 59, "FIGS. 21" should be --FIGS. 21a--.

Col. 7, line 44, "permanent" should be --permanently--.

Col. 7, line 52, "element," should be --element.--

Col. 7, lines 53-58, delete in their entirety. They are duplicative of lines 47-52.

Signed and Sealed this

Twenty-seventh Day of September, 1994

*Attest:*

*Attesting Officer*

Bruce Lehman

BRUCE LEHMAN

*Commissioner of Patents and Trademarks*